United States Patent [19]

Crowe et al.

[11] 4,138,836

[45] Feb. 13, 1979

[54] MACHINE FOR PLACING FLAT ARTICLES IN A CASE

[75] Inventors: Norman P. Crowe, Miami Township, Clermont County; Joseph M. Lohse, Terrace Park, both of Ohio

[73] Assignee: Multifold-International, Inc., Milford, Ohio

[21] Appl. No.: 833,591

[22] Filed: Sep. 15, 1977

[51] Int. Cl.[2] ..... B65B 57/20; B65B 35/50; B65B 39/12

[52] U.S. Cl. ..... 53/500; 53/67; 53/249; 53/505; 53/535; 214/6 H

[58] Field of Search ..... 53/61, 62, 63, 67, 162, 53/163, 249, 159; 214/6 H

[56] References Cited

U.S. PATENT DOCUMENTS

| | | | |
|---|---|---|---|
| 2,656,656 | 10/1953 | Murdoch et al. | 53/63 X |
| 3,673,756 | 7/1972 | Prete et al. | 53/61 |

*Primary Examiner*—Travis S. McGehee

*Attorney, Agent, or Firm*—James W. Pearce; Roy F. Schaeperklaus

[57] ABSTRACT

A machine which drops flat articles such as flattened cartons into a case. The articles are delivered to a basket having a floor which can be opened. The basket is mounted for up and down movement. The case is mounted below the basket with its top open and can be held in position by vacuum cup means. When the stack has been formed, the flow of articles is halted and the basket can be lowered into close proximity to the open top of the case. The basket floor is opened to drop the stack into the case. If desired, two stack sections can be formed and dropped into a single case one after the other. When the stack has been dropped into the case, the basket is raised to free the basket from the case. The vacuum is released, and the case is then advanced laterally out of alignment with the basket. The case can then be raised by a lift table to a convenient height for inspection and, following inspection, can be discharged. A new case is placed beneath the basket in engagement with the vacuum cup means, and the flow of articles is restarted to form a new stack.

5 Claims, 28 Drawing Figures

16

1098
1106
1102
1100
1104
1108
1094
1092
1096
LS-2
1118
1122
1124
1120
1126
1128
1130
LS-12
1114
896
900
1116
26
1090
1076
852R
856
1078
1060
1074
1080
1068
1082
1084
1066
1064
1070
1058
1056
1054
1062
858
918
892
920
922
920
1036
1006
1010
894
860
924
1086R
27
1002
LS-14
1038
1088R
1040
1042
1086L
1048
1046
LS-14A
1044
890
862
1068
1066
1070
1010
1006
916
1036
854
852L
1082
1088L
1080
1084
1078
1076
950
908
906
896
902A
926
900
910A
912
910B
914
888
910C
22
22

27
23
LS-2
1118
1082
1084
1122
1124
1126
1114
1080
1066
1120
1128
1074
1056
1130
LS-12
1060
1054
1086L
1050
852L
1116
1076
942
1064
858
26
850R
1058
1046
950
1048
1106
1112
1044
926
928
1070
LS-14A
930
894
888
1104
1068
932
902A
1072
904
1100
1094
896
898
1102
1110
906
900
1092
1098
908
902B
1036
850L
982
972
970
946
938
1042
24
1043
974
968
958
1002
1006
24
1026
980
962
956
952
936
934
880
48
40L
978
966
954
994
964
944
884
886
854
882
878
958
960
862
876L
844
1022
992
948
864
42L
864
1028
984
846L
940
872
870
1032
1030
866
868
874
1024
936
23

MACHINE FOR PLACING FLAT ARTICLES IN A CASE

This invention relates to a machine for placing flat articles such as flattened cartons or the like in a case. More particularly, this invention relates to a machine which drops a stack of cartons into the case.

An object of this invention is to provide such a machine having a basket provided with a basket bottom or floor which can be opened to drop the stack into the case.

A further object of this invention is to provide such a machine in which the basket has an open side through which the articles are introduced into the basket to form the stack in the basket.

A further object of this invention is to provide such a machine in which the basket can be lowered into proximity to the case when the stack has been accumulated in the basket so that the stack can be dropped directly into the case.

A further object of this invention is to provide such a machine in which there is vacuum cup means for holding the case in position for dropping of the stack from the basket and means for preventing delivery of a stack until the case is in position engaging the vacuum cup means.

A further object of this invention is to provide such a machine in which, after a selected portion of a stack of articles has been formed in the basket, additional articles are advanced into the basket only when a case is held by the vacuum cup means.

Briefly, this invention provides a machine which delivers flat articles such as flattened cartons into a basket having a floor which can be opened. The articles form a stack in the basket. The articles can be delivered in a shingled stream, and the basket is mounted for up and down movement so that the level of the top of the stack can be maintained constant as the articles are delivered to the basket. A case having an open top is mounted below the basket and is held in position by vacuum cup means. A part of a stack can be formed in the basket before the case is placed in position. The vacuum of the vacuum cup means actuates a switch when the case is in position. The vacuum operated switch permits continuation of delivery of the articles to the basket to complete the stack. When the stack in the basket has reached a predetermined height and includes a predetermined number of articles, flow of articles to the basket is arrested. The basket can then be lowered into close proximity to the open top of the case, and the basket bottom is opened to drop the stack into the case. If desired, two stack sections can be formed and dropped into a single case one after the other. When the stack has been dropped into the case, the basket is raised to free the basket bottom from the case and to return the basket to article receiving position. The vacuum is released, and the case is then advanced laterally out of alignment with the basket. The case can then be raised to a convenient height for inspection and, following inspection, can be discharged. Meanwhile, articles are advanced to the basket to start formation of a new stack. A new case is placed beneath the basket in engagement with the vacuum cup means, and the vacuum is reimpressed to permit continuation of flow of articles into the basket to complete formation of the new stack.

The above and other objects and features of the invention will be apparent to those skilled in the art to which this invention pertains from the following detailed description and the drawings, in which.

In the following detailed description and the drawings, like reference characters indicate like parts.

Figure 1:
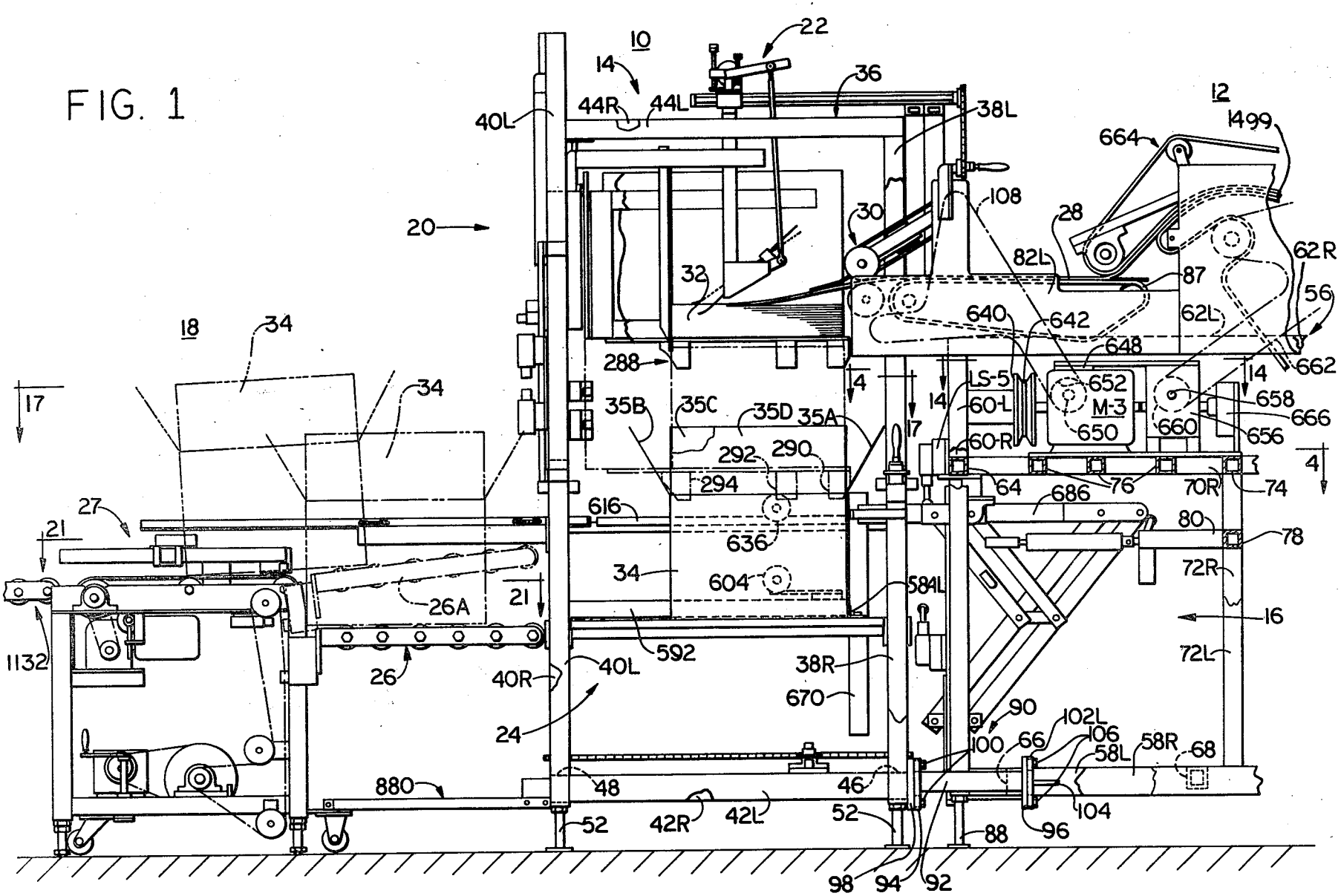
FIG. 1 is a somewhat schematic view in side elevation of a carton packing machine constructed in accordance with an embodiment of this invention, parts being broken away to reveal details of construction.

In FIG. 1 is shown a carton packing machine 10 which is constructed in accordance with an embodiment of this invention.

The carton packing machine 10 is used in conjunction with a carton assembling machine 12, only the output end of which is shown in FIG. 1. The carton assembling machine 12 can be of the type shown in our copending application Ser. No. 778,129, filed March 16, 1977. The carton packing machine 10 includes a packing assembly 14, a case discharge pusher 16, and a case discharge assembly 18. The packing assembly 14 includes an elevator assembly 20, a rate valve assembly 22 and a case retaining assembly 24. The rate valve assembly 22 and the case discharge pusher 16 are rigidly affixed to the framework of the carton assembling machine 12, as will be described hereinafter. The case discharge assembly 18 includes a case lift table 26 and a belt discharge assembly 27.

DEFINITION OF TERMS

A definition of logistical terms is now in order. The reader, in viewing FIG. 1, is looking at the left side of the carton packing machine 10, which is also known as the operator side of the machine. A procession of flattened cartons 28 passes from right to left through the carton assembling machine 12, to be discharged through a nip roll assembly 30 into the carton packing machine 10. As the procession of cartons 28 enters the carton packing machine 10, its longitudinal movement is stopped, thus transforming the procession of flattened cartons 28 into a stack of cartons 32. Subsequently, the stack of cartons 32 moves vertically downward and is inserted into a corrugated case 34, which is then discharged to the left of the figure by means of the case discharge pusher 16 and the case discharge assembly 18. The end of the carton packing machine 10 to the right side of FIG. 1 is the input end.

FRAME

Figure 2:
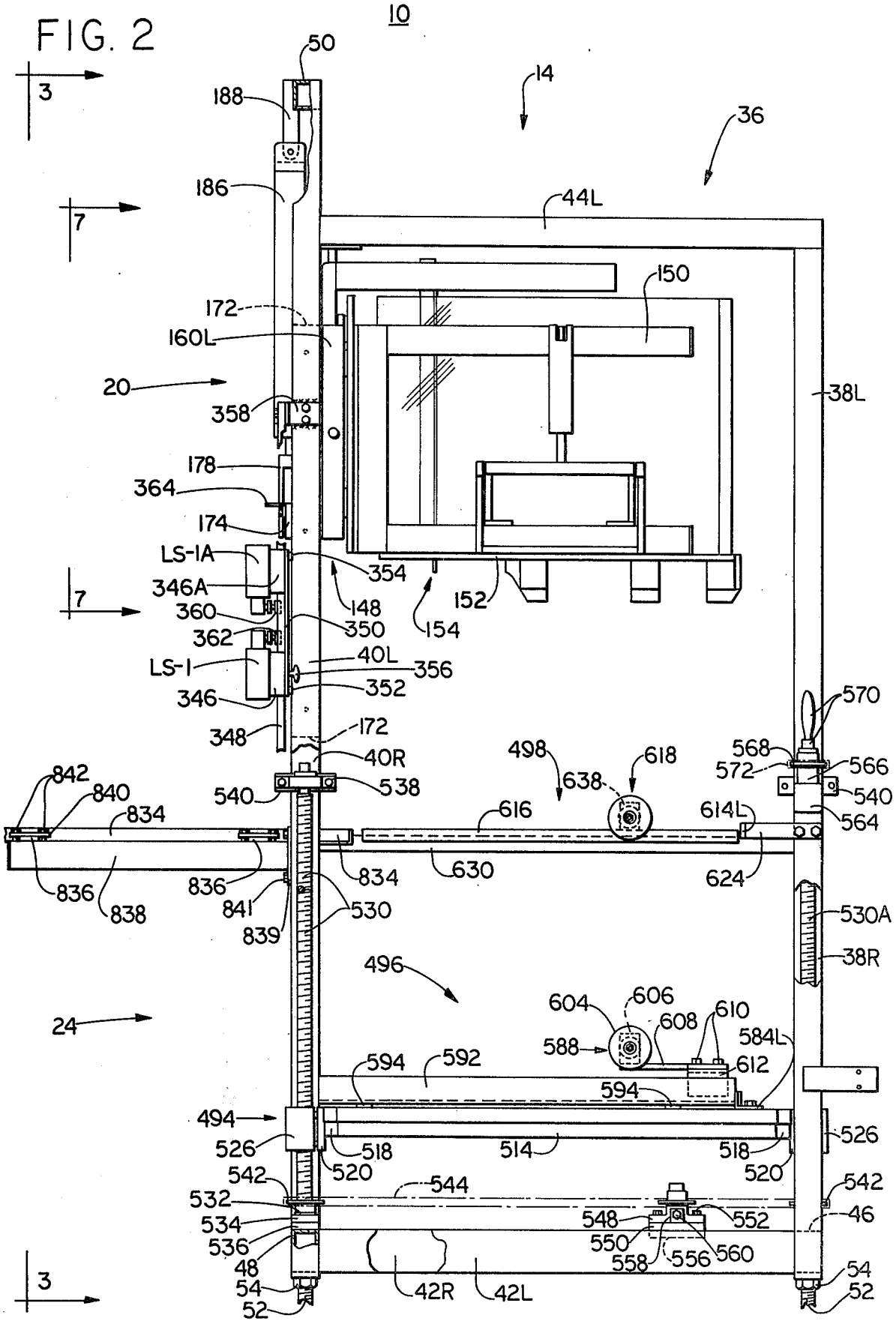
FIG. 2 is a view in side elevation on an enlarged scale of an elevator and case packing section of the machine, partly broken away to show details of construction.
Figure 3:
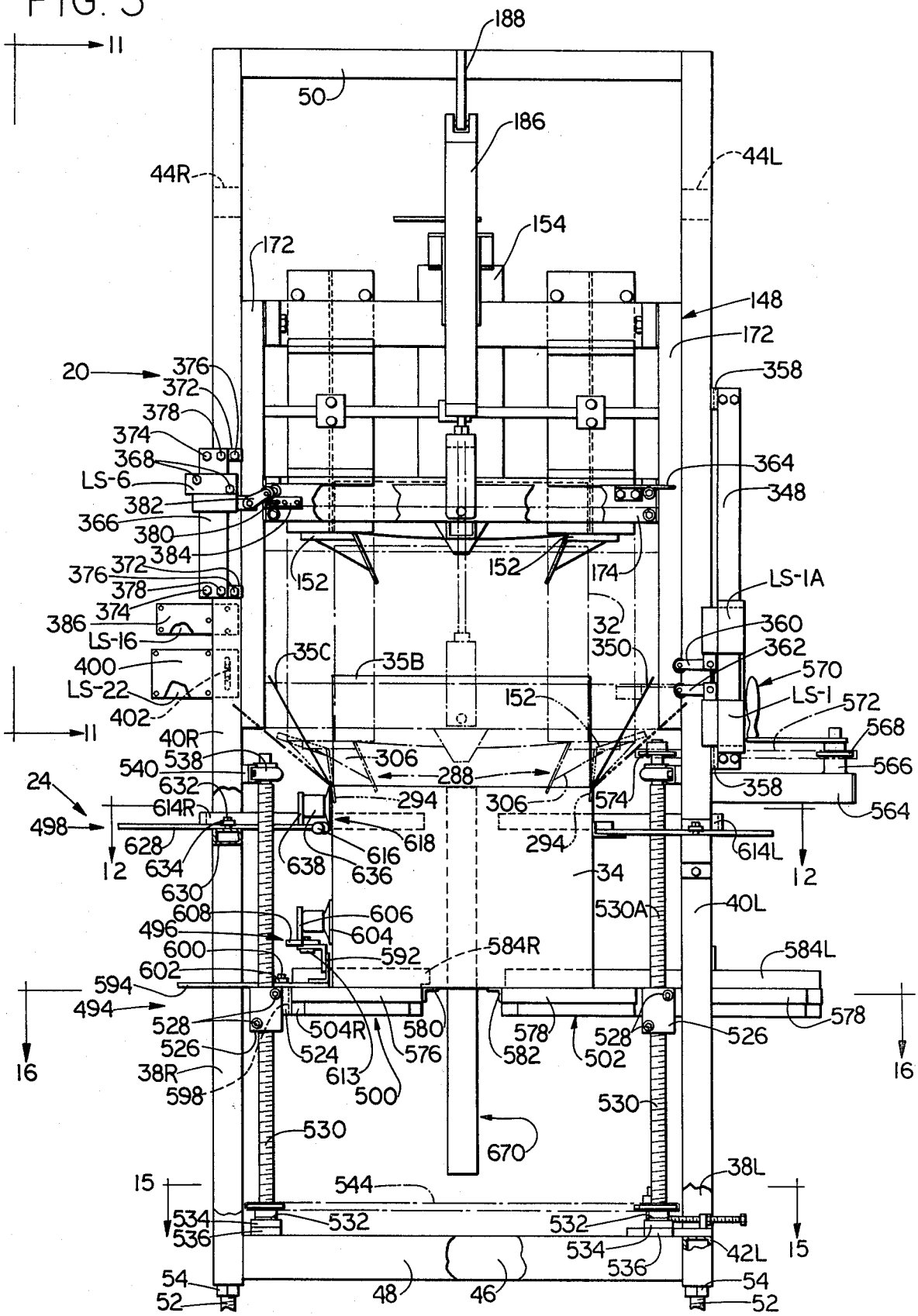
FIG. 3 is a view in end elevation of the elevator and case packing section of the machine, taken along line 3—3 in FIG. 2, the elevator section being shown in a down or packing position in dot-dash line, a corrugated case being in position within the machine, and parts being partly broken away and in section and output rails being omitted for structural clarity.

A frame assembly 36 of the carton packing machine 10 is shown in FIGS. 1, 2 and 3, and is comprised of input posts 38L and 38R, output posts 40L and 40R, bottom stringers 42L and 42R, and top stringers 44L and 44R. The left hand bottom stringer 42L is rigidly affixed between, and at the lower ends of, the left hand members of the output post 40L and the input post 38L. The output extremity of the left had top stringer 44L is rigidly affixed to the input face of the left hand output post 40L, approximate to the top thereof, while its input end is rigidly affixed upon the top extremity of the left hand input post 38L. A rectangular shaped left side frame is thus formed, the right side of the frame assembly 36 being formed in identical manner. The left and right sides of the frame assembly 36 are held in spaced and parallel reltaionship by a bottom input lateral beam 46, a bottom output lateral beam 48, and a top output lateral beam 50, all of which are rigidly affixed to the inboard surfaces of the left and right sides of the frame assembly 36, respectively, as is shown in FIGS. 2 and 3.

The frame assembly 36 is supported above the floor by a set of four adjustable legs 52. The legs 52 are threaded into the closed bottoms of the input posts 38L and 38R and the output posts 40L and 40R. After proper leveling of the carton packing machine 10 (FIG. 1) the set of four adjustable legs 52 is set in fixed place by a set of four lock nuts 54.

Figure 4:
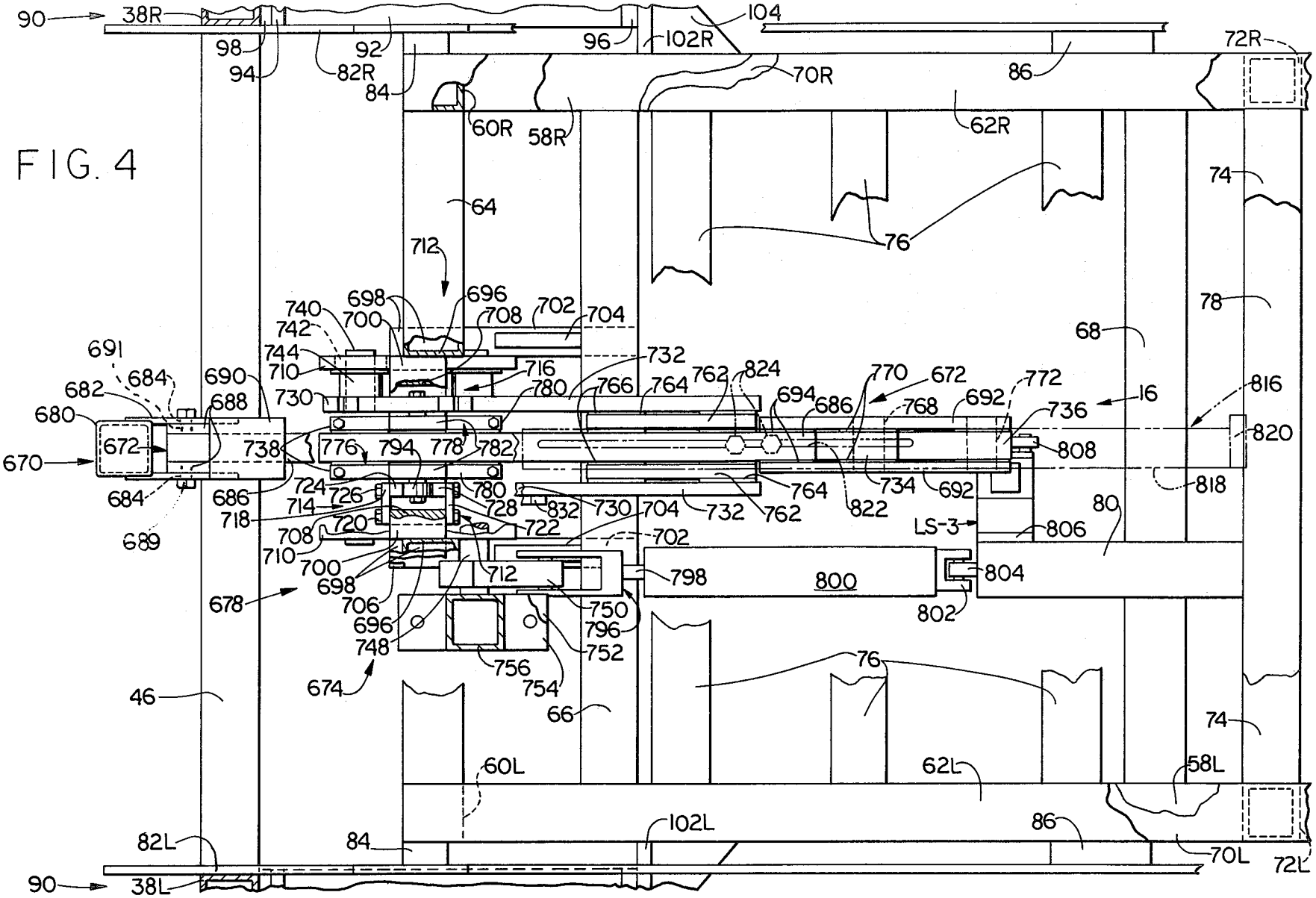
FIG. 4 is a view on an enlarged scale of a case discharge pusher taken along the line 4—4 in FIG. 1, parts being partly broken away and in section for structural clarity, a switch actuating plate being shown in double-dot-dash lines.

The carton packing machine 10 is set in close longitudinal line with, and adjacent to the output end of the carton assembly machine 12, as is shown in FIG. 1. An assembly machine framework 56, shown in FIGS. 1 and 4, is partially comprised of base stringers 58L and 58R, output risers 60L and 60R, and upper stringers 62L and 62R. The partially described assembling machine framework 56 is held in lateral spaced relationship by an upper output transverse beam 64, a base transverse beam 66, and a base middle stiffener 68. Other lateral frame members associated with the input end of the assembling machine framework 56 have been omitted. The output end of the assembling machine framework 56 also comprises middle stringers 70L and 70R whose output ends are rigidly affixed to the input faces of the output risers 60L and 60R, respectively, and adjacent to the intersection of the upper output transverse beam 64. Middle riser supports 72L and 72R are mounted on the base stringers 58L and 58R and support the middle stringers 70L and 70R. A middle stiffener 74 spans the middle stringers 70L and 70R. A set of three power pack mount beams 76 is also rigidly affixed between the pair of middle stringers 70L and 70R and distributed therealong between the upper output transverse beam 64 and the middle stiffener 74. An actuator lateral mount beam 78 is rigidly affixed between the middle riser supports 72L and 72R to rigidly accommodate an actuator mount beam 80 that is in turn cantilever mounted from the output face thereof. As can be more easily seen in FIG. 4, mount plates 82L and 82R are mounted on the outboard surfaces of the upper stringers 62L and 62R, respectively, by a pair of output spacer blocks 84 and a pair of input spacer blocks 86. The mount plates 82L and 82R are of irregular shape and form the mounting structure for the nip roll assembly 30 and a carry-off belt assembly (not shown in detail). The carry-off belt assembly is mounted between the pair of mount plates 82L and 82R and supports a belt conveyor 87 which advances articles to the nip roll assembly 30. The mount plates 82L and 82R also function as mounting members for the rate valve assembly 22 to be discussed in detail hereinafter. The assembling machine framework 56 is adjustably mounted upon a set of four legs 88, partially shown in FIG. 1, which are similar to those employed for the frame assembly 36 of the carton packing machine 10.

The frame assembly 36 and the assembling machine framework 56 are fixedly held in longitudinal spaced relationship by a pair of coupling assemblies 90 shown in FIGS. 1 and 4. Each member of the pair of coupling assemblies 90 is comprised of a coupling bar 92 that rigidly incorporates at its output end a packing frame flange 94, and at its input end an assembling frame flange 96.

The packing frame flange 94 is adjustably and fixedly attached to a packing frame mount plate 98 by means of bolts 100 (FIG. 1) that pass through vertical slots in the packing frame flange 94 and threadably mount into the packing frame mount plate 98. The packing frame mount plates 98 are each rigidly affixed to the input face of, and at the bottom ends of one of the input posts 38L and 38R, as is partially shown in plan view in FIG. 4.

Assembling frame mount plates 102L and 102R are rigidly affixed along their inboard edges to the outboard surfaces of the pair of base stringers 58L and 58R, respectively, adjacent to the intersection of the base transverse beam 66. Perpendicularity between the assembling frame mount plates 102L and 102R and the base stringers 58L and 58R is assured by a pair of gussets 104. The assembling frame flange 96 is fixedly attached to its respective member of the assembling frame mount plates 102L and 102R by bolts 106 that pass through vertical slots within each member of the assembling frame mount plates 102L and 102R and threadably mount into the assembling frame flange 96. In this manner, the frame assembly 36 and the assembling machine framework 56 can be fixedly coupled after each have been set up and leveled.

CARTON ASSEMBLING MACHINE

Figure 5:
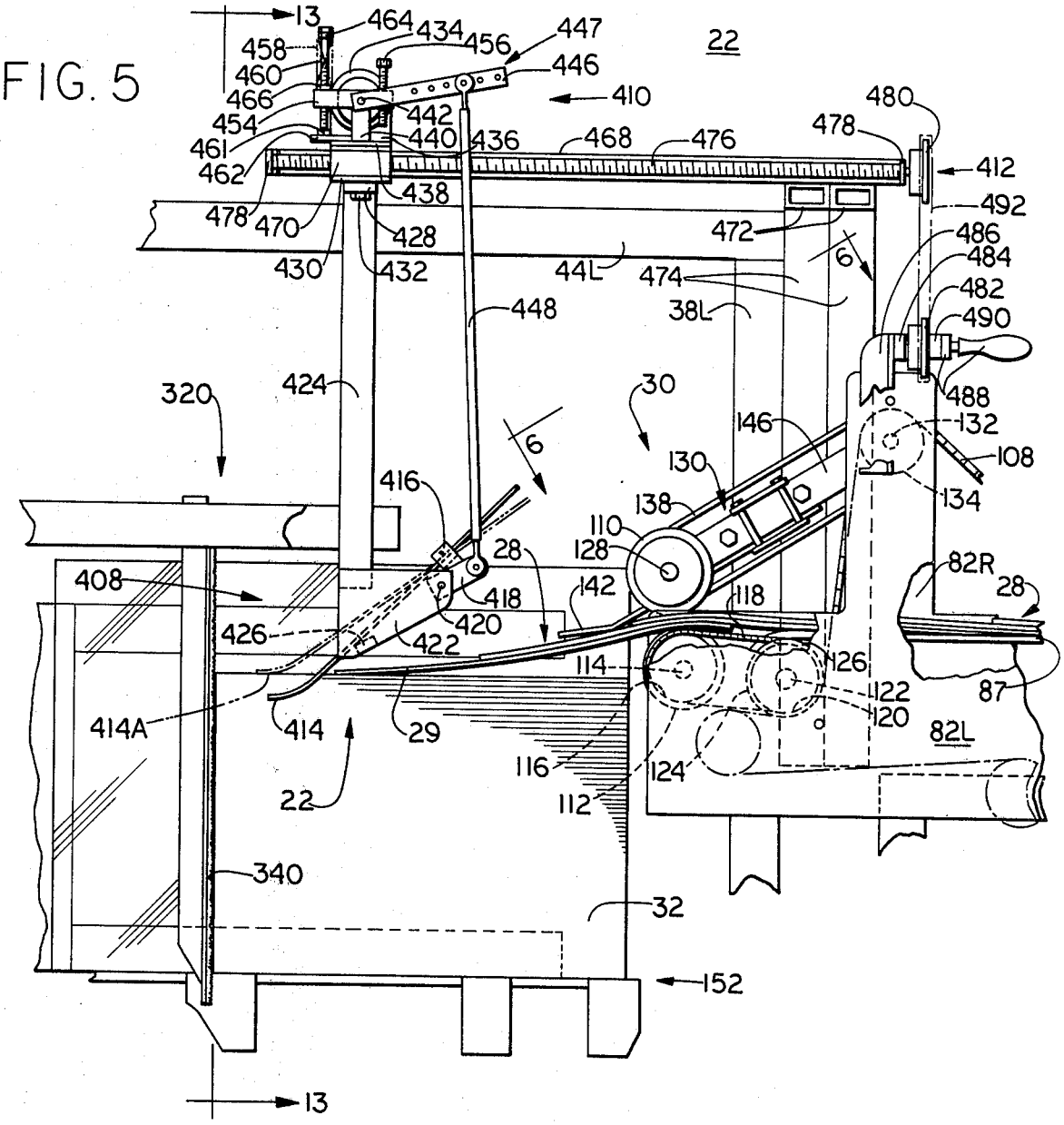
FIG. 5 is a fragmentary partly schematic view in side elevation, partly broken away and in section showing operation of the elevator section.
Figure 6:
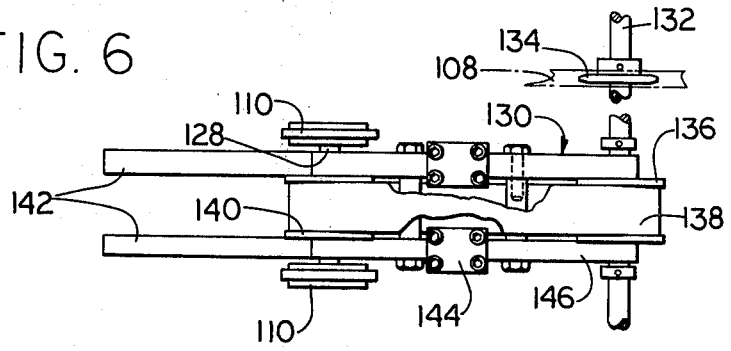
FIG. 6 is a fragmentary view taken in the direction of the arrows 6—6 in FIG. 5, showing an upper nip roll assembly of the machine.

The procession of flattened carton 28 is delivered to the rate valve assembly 22 by the nip roll assembly 30 which receives the articles from the belt conveyor 87 as is shown in FIGS. 1 and 5. The belt conveyor 87 is driven by a drive chain 108. The nip roll assembly 30 includes upper nip rolls 110 (FIG. 6) and lower nip rolls 112, only one of which is shown in FIG. 5. The lower nip rolls 112 are mounted on a shaft 114 that is rotatably mounted between the mounted plates 82L and 82R. A sprocket 116 is mounted on the shaft 114 and is driven by a short drive chain 118. The short drive chain 118 is driven by a sprocket 120 carried by a shaft 122 which is also rotatably mounted between the mount plates 82L and 82R. The shaft 122 also carries a sprocket 124 on which the drive chain 108 runs. The shaft 122 also carries a pulley 126 on which the conveyor belt 87 runs.

The upper nip rolls 110 are mounted on a shaft 128 (FIGS. 5 and 6) which is rotatably mounted in an upper nip roll frame 130. The upper nip roll frame 130 is rotatably mounted on a shaft 132 that is in turn rotatably mounted between the mount plates 82L and 82R. A sprocket 134 is mounted on the shaft 132 and is driven by the drive chain 108. A pulley 136 (FIG. 6) is mounted on the shaft 132 and drives a belt 138. The belt 138 drives a pulley 140 mounted on the shaft 128 to drive the upper nip rolls 110. The upper and lower nip rolls are mounted in opposition to drive the procession of flattened cartons 28 onto the top of the stack of cartons 32 as the cartons leave the conveyor belt 87. Elongated leaf spring members 142 are carried by clamp brackets 144 that are mounted on frame bars 146 of the upper nip roll frame 130. The elongated leaf spring members 142 guide the articles downwardly onto the stack of cartons 32.

CARTON ASSEMBLING MACHINE

(Elevator Assembly)

As the procession of flattened cartons 28, or articles, leave the nip roll assembly 30, they enter the elevator assembly 20 of the packing assembly 14 of the carton packing machine 10 as is shown in FIGS. 1, 2 and 3. The elevator assembly 20 is comprised of an elevator structure 148, a basket frame 150, a basket floor 152, a basket backstop 154, and appropriate limit switches.

Figure 7:
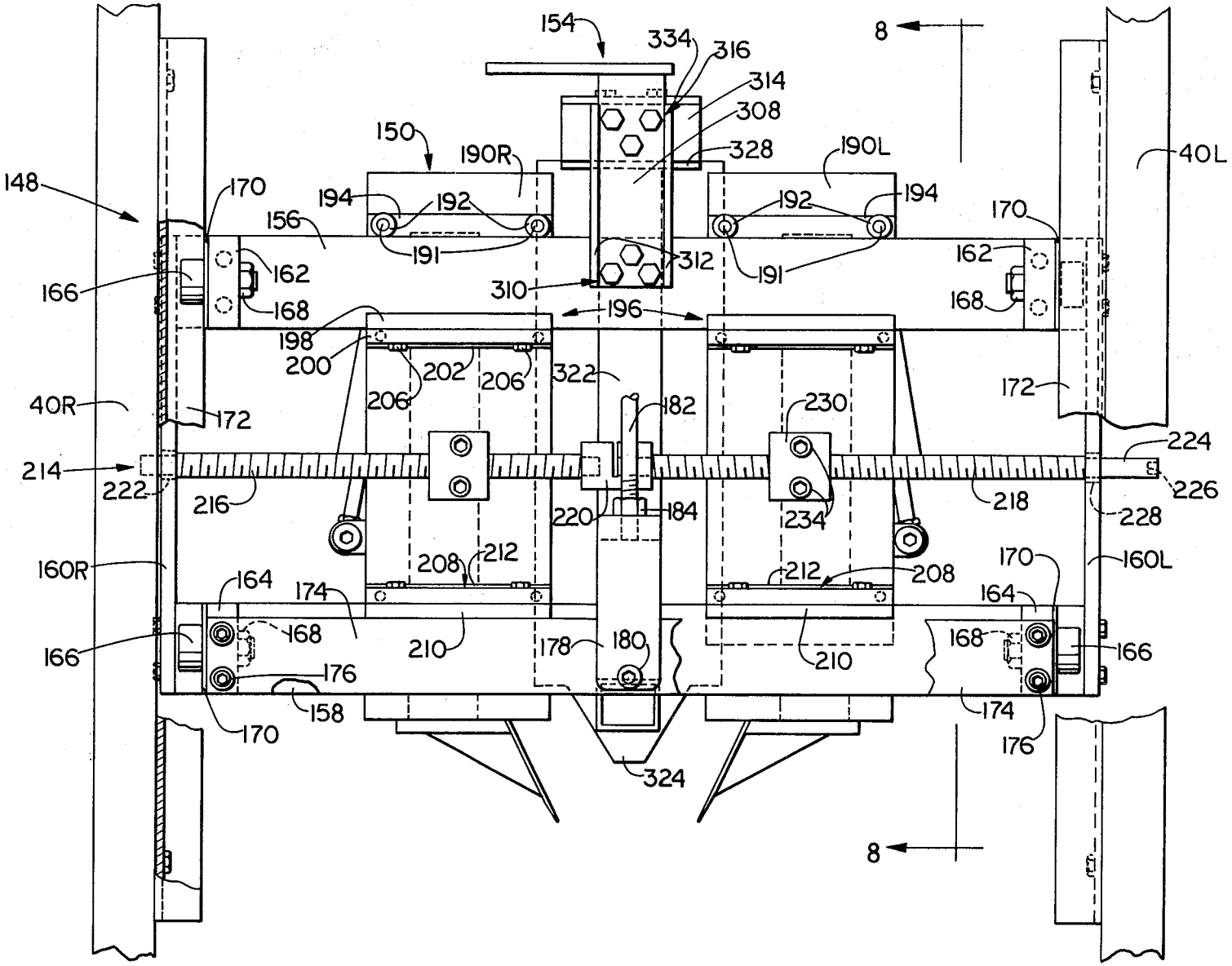
FIG. 7 is a view in end elevation on an enlarged scale of the elevator section taken along line 7—7 in FIG. 2, partly broken away and in section for structural clarity.
Figure 8:
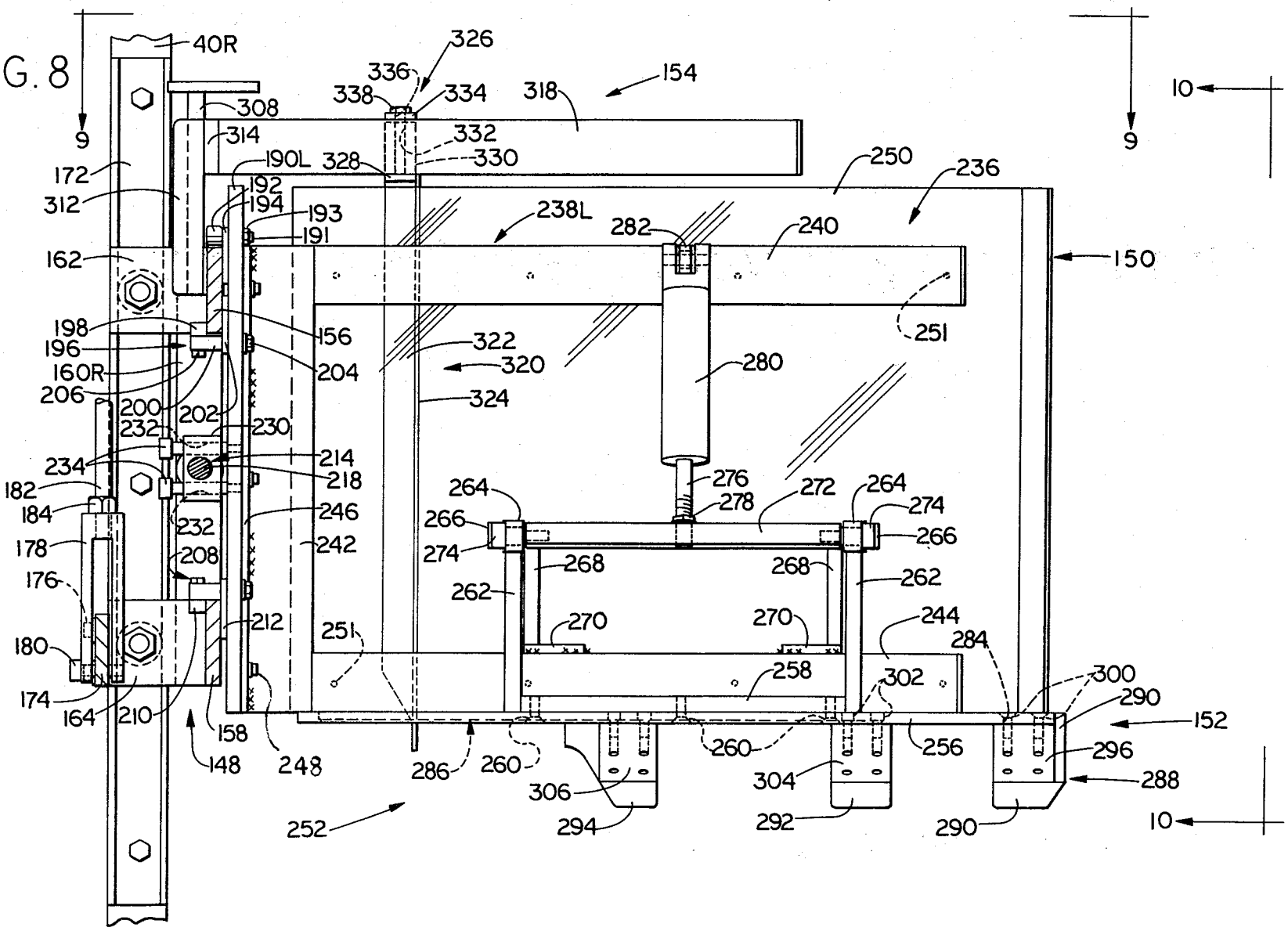
FIG. 8 is a view in longitudinal upright section taken along the line 8—8 in FIG. 7.
Figure 10:
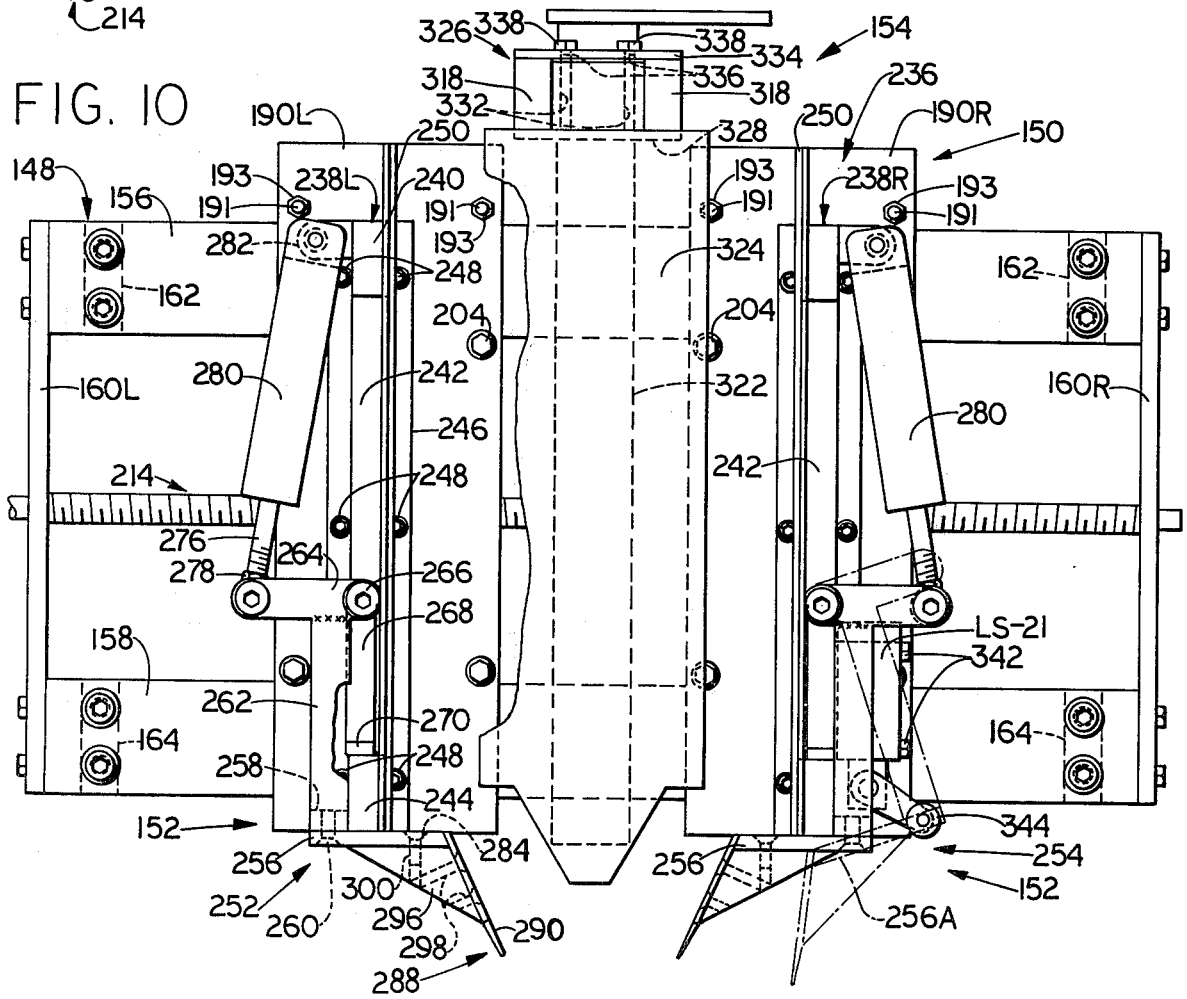
FIG. 10 is a fragmentary end elevational view taken in the direction of the arrows 10—10 in FIG. 8.

Referring now to the more detailed FIGS. 7, 8 and 10, the elevator structure 148 incorporates an upper mount beam 156 and a lower mount beam 158 that are held in parallel and vertical spaced relationship by frame plates 160L and 160R. The upper and lower ends of the frame plates 160L and 160R are fixedly attached to the ends of the upper mount beam 156 and the lower mount beam 158, respectively, to form the rectangularly shaped framework of the elevator structure 148.

Fixedly attached to the output surface of, and approximate the ends of the upper mount beam 156, is a pair of upper roller mounts 162. In the same manner, a pair of lower roller mounts 164 is fixedly attached to the lower mount beam 158. The upper and lower roller mounts 162 and 164 respectively fixedly incorporate upon their outboard surfaces a set of four slide shoes 170, as is shown in FIG. 7. The upper and lower roller mounts 162 and 164 also respectively incorporate a set of four rollers 166, rotatably mounted upon shoulder type shafts (not shown) that pass through clear holes in the set of four slide shoes 170 to be fixedly attached within the output sides of the upper and lower roller mounts 162 and 164 by a set of four nuts 168. The set of four rollers 166 ride vertically within the confines of a pair of channel rails 172 that is in turn fixedly attached to the inboard surfaces of the output posts 40L and 40R, toward the upper portion thereof as is shown in FIG. 3. The lateral placement of the pairs of upper and lower roller mounts 162 and 164, respectively, is such that the set of four slide shoes 170 slide upon the inboard edges of the pair of channel rails 172, thus holding the elevator structure 148 in lateral place and in vertical alignment without binding its movement.

An actuator bar 174 (FIGS. 7 and 8) spans the output ends of the pair of lower roller mounts 164, and is fixedly attached thereto by a set of four bolts and washers 176. An actuator clevis 178 is pinned to the center of the actuator bar 174 by a clevis bolt 180 that passes through clear and aligned holes in the output tine of the actuator clevis 178 and the actuator bar 174 to threadably mount into the input tine of the same actuator clevis 178. The upper portion of the actuator clevis 178 threadably incorporates a cylinder rod 182 that is fixedly held in place by a lock nut 184. The cylinder rod 182 is the working element of an elevator cylinder 186 that is shown in FIGS. 2 and 3. The upper extremity of the elevator cylinder is pivotally mounted to the lower end of a cylinder mount 188 that is in turn rigidly affixed to the outboard surface of, and at the center span of the top output lateral beam 50. In this manner, the elevator structure can be moved up and down with precision, while keeping its orientation with respect to other axes.

The basket frame 150 is shown in detail in FIGS. 7, 8, 9 and 10. The basket frame 150 incorporates lateral roller plates 190L and 190R. Each of the lateral roller plates 190L and 190R is vertically retained upon the upper mount beam 156 of the elevator structure 148 by means of a pair of rollers 192. The rollers 192 are rotatably mounted upon the output ends of shoulder shafts 191, which are fixedly attached into the output side of the lateral roller plates 190L and 190R, and near the top thereof by a pair of nuts 193. The shoulder shafts 191 pass through clear holes in an upper slide shoe 194 to retain it between the rollers 192 and the output surface of its respective lateral roller plates 190L and 190R. The upper slide shoes 194 extend downwardly to provide sliding spaced relationship between the lateral roller plates 190L and 190R and the upper mount beam 156.

Longitudinal retention of the lateral roller plates 190L and 190R upon the upper mount beam 156 is provided by a pair of upper slide retainers 196. Each of the upper slide retainers is comprised of a retainer bar 198, a base 200, and a middle slide shoe 202. Mounting bolts 204 (FIGS. 8 and 10) pass through clear holes in the lateral roller plates 190L and 190R, through clear holes in the middle slide shoes 202 and threadably mount into the bases 200, thus clamping the middle slide shoes 202 between the bases 200 and the lateral roller plates 190L and 190R. As shown in FIGS. 7 and 8, each retainer bar 198 is fixedly attached to the top output edge of the associated base 200 by a pair of bolts 206, capturing the lower edge of the upper mount beam 156 between the retainer bar 198 and the middle slide shoe 202.

Lower portions of the lateral roller plates 190L and 190R are slidably retained upon the top edge of the lower mount beam 158 by lower slide retainers 208. The upper and lower pairs of slide retainers 196 and 208 respectively, are the same in construction and mounting, save for the fact that a retainer bar 210 is mounted to the bottom output surface of its base, thus capturing the top edge of the lower mount beam 158 between it and a bottom slide shoe 212. Thus, the lateral roller plates 190L and 190R can move laterally in either direction upon the upper and lower mount beams 156 and 158 respectively, while retaining proper vertical disposition.

The lateral roller plates 190L and 190R are moved laterally upon the upper and lower mount beams 156 and 158 by a compound jack screw 214 as shown in FIGS. 7 and 8. The compound jack screw 214 includes a right hand segment 216 and a left hand segment 218. The right hand segment 216 incorporates a left hand thread, the left hand segment 218 incorporates a right hand thread, the two segments being fixedly attached to each other at the center of the machine by a shaft coupler 220. The right hand extremity of the right hand segment 216 is rotatably retained in a bushing 222 that is frictionally pressed into a clear hole in the center of the right hand frame plate 160R. The left hand extremity of the left hand segment 218 rigidly incorporates a clear shaft extension 224 of reduced diameter, the free end of which incorporates an Allen wrench receptacle 226. The shaft extension 224 is rotatably retained in a bushing 228 that is frictionally pressed into a clear hole in the center of the left hand frame plate 160L. Thus, when a wrench (not shown) is mounted in the Allen wrench receptacle 226, the compound jack screw 214 can be rotated in either direction.

The left hand segment 218 of the compound jack screw 214 threadably passes through an attachment block 230. As can be seen in FIGS. 7 and 8, the attachment block 230 incorporates a pair of clear longitudinal holes 232 through which shoulder bolts 234 pass to threadably mount into the output side of the left hand lateral roller plate 190L. As is shown in FIG. 8, the unthreaded shanks of the shoulder bolts 234 are considerably longer than the thickness of the attachment block 230, thus permitting a longitudinal degree of freedom to the attachment block 230 as it rides transversely along the left hand segment 218. The right hand lateral roller plate 190R is attached to and laterally motivated by the right hand segment 216 of the compound jack screw 214 in the same manner as the left hand lateral roller plate 190L. As the operator turns the compound jack screw 214 with the aid of a wrench inserted in the Allen wrench receptacle 226, the lateral roller plates 190L and 190R are moved in opposition to increase or decrease the lateral distance between them.

Figure 9:
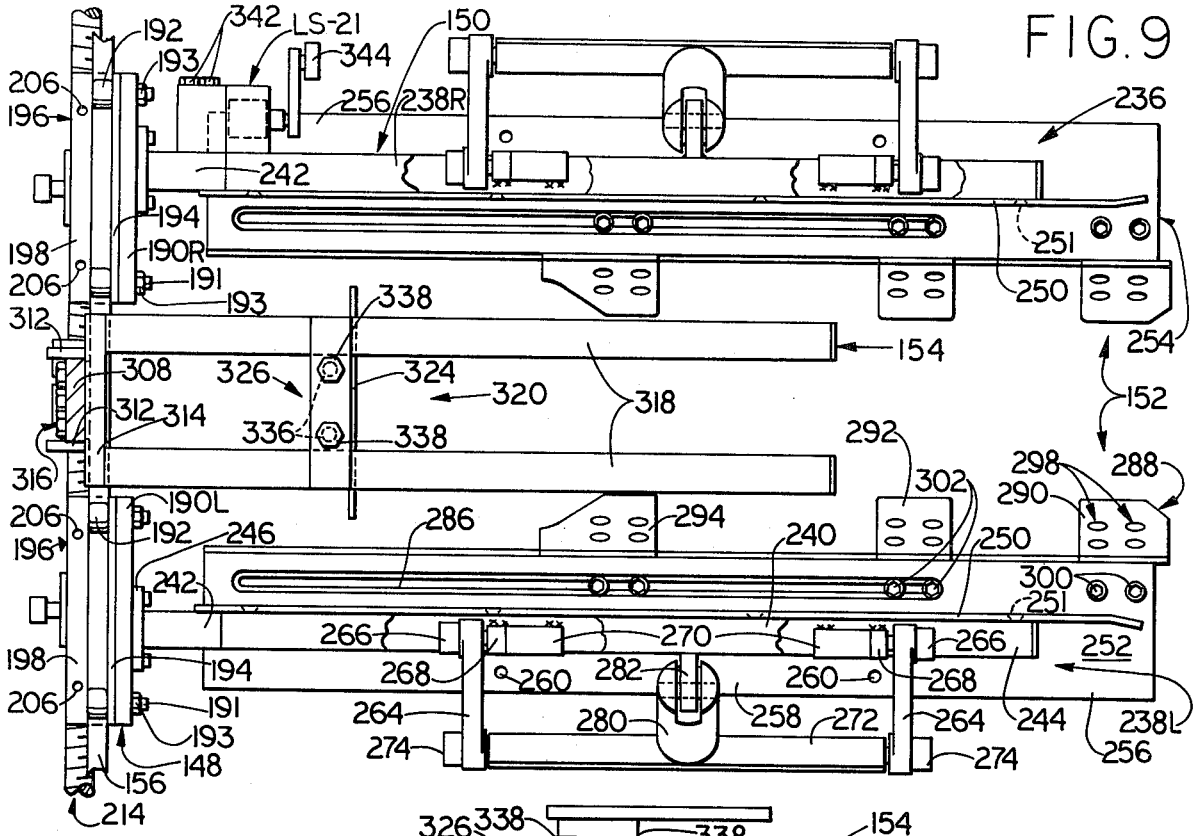
FIG. 9 is a fragmentary plan view taken along the line 9—9 in FIG. 8, parts being partially cut away for clarity.

The basket frame 150 also incorporates a side frame assembly 236 that is shown in FIGS. 8, 9 and 10. The side frame assembly 236 is comprised of side frame weldments 238L and 238R, each of which is comprised of a top horizontal beam 240, a vertical mount post 242, a bottom horizontal beam 244 and a mount plate 246. The output extremity of the top horizontal beam 240 is rigidly affixed to the top input surface of the vertical mount post 242, the output extremity of the bottom horizontal beam 244 is rigidly affixed to the bottom input surface of the vertical mount post 242, and the output surface of the vertical mount post 242 is rigidly affixed to the center of the input face of the mount plate 246. This forms a C-shaped frame that is fixedly attached to the input surface of the respective lateral roller plate 190L or 190R by a set of six bolts 248. Fixedly attached to the inboard surfaces of the side frame weldments 238L and 238R is a pair of side guide plates 250 whose input edges are turned outwardly to facilitate the entrance of the procession of flattened cartons 28. The side guide plates 250 are fixedly attached to the side frame weldments 238L and 238R, each by a set of eight flat head machine screws 251 that pass through clear countersunk holes in the side guide plates 250 and threadably mount into the top and bottom mount beams 240 and 244, as is indicated in FIGS. 8 and 9.

The basket floor 152 is shown in FIGS. 8, 9 and 10, and includes a left hand assembly 252 and a right hand assembly 254. The left and right hand assemblies 252 and 254 are similar except for right and left handedness and mirror image effects; therefore, only the left hand assembly 252 will be described in detail. The left hand assembly 252 of the basket floor 152 incorporates a carton retainer plate 256 that is fixedly attached along its top outboard edge to the bottom surface of a mount bar 258 by a set of three flat head machine screws 260, as is best shown in FIG. 8. Rigidly affixed to the ends of the mount bar 258 is a pair of offset radius arms 262 that rise upward to rigidly incorporate transversely across their upper ends a pair of pivot arms 264. The inboard extremities of the pivot arms 264 are pivotally mounted (FIG. 9) upon shoulder bolts 266. The shoulder bolts 266 threadably mount into the top ends of vertical pivot mounts 268, which are rigidly affixed to the top outer ends of mount bases 270. The mount bases 270 are rigidly affixed to the top surface of and at about the center span of, the bottom horizontal beam 244. Pivotally mounted between the outboard extremities of the pair of pivot arms 264 by a pair of shoulder bolts 274 is an actuator beam 272. A cylinder rod 276 is threadably mounted into the top surface of, and at the center span of the actuator beam 272, and locked in place therein by a lock nut 278. The cylinder rod 276 is the working extremity of a cylinder 280, which is pivotally attached to the outboard end of a cylinder mount 282 that is in turn rigidly affixed to the outboard surface of the top horizontal beam 240. As shown in full lines in FIG. 10, the cylinder 280 is fully extended. Upon retraction, the pairs of pivot arms and offset radius arms 264 and 262 respectively, pivot about the pair of shoulder bolts 266, swinging the carton retainer plates 256 slightly downward but mostly outwardly so that at full stroke the carton retainer plates 256 swing to the position at which one of the carton retainer plates is shown at 256A, and the stack of cartons 32 drops out of the basket frame 150.

The carton retainer plate 256, as is shown in FIGS. 8, 9 and 10, incorporates a pair of countersunk holes 284 near the inboard input corner thereof, and an elongated stepped slot 286 that extends along most of the inboard edge thereof. The inboard edge of the carton retainer plate 256 is cut on a bevel, the purpose of which is to cooperate with a set of three flap guides 288. The set of three flap guides 288 is comprised of an input guide 290, a middle guide 292 and an output guide 294.

The input guide 290 is a rectangular plate whose lower portion is tapered to a releatively fine edge (FIG. 10), the bottom input edge of the input guide 290 is cut off at an angle, and the top edge is bevel cut to cooperate with the upper surface of the carton retainer plate 256. The bottom input edge is cut off at an angle to provide a means for guiding the input flap of the corrugated carton 34 outwardly with respect thereto, as will be described more fully hereinafter. The input guide 290 is fixedly attached to the inboard face of an input triangular mount 296 by a set of four flat head machine screws 298 that passes through clear holes in the face thereof and threadably mount in the input triangular mount 296. The input triangular mount 296 is fixedly attached to the bottom of the carton retainer plate 256 by a pair of flat head machine screws 300 that passes through the pair of countersunk holes 284 to threadably mount into the top of the input triangular mount 296.

The middle guide 292 is a rectangular plate whose lower portion is tapered to a relatively fine edge, and whose top edge is beveled to cooperate with the top surface of the carton retainer plate 256. The attachment of the middle guide 292 to the carton retainer plate 256 is similar to that of the input guide 290 with the exception of a pair of Allen head bolts 302, each of which passes through the elongated stepped slot 286 to threadably mount into a middle triangular mount 304 (FIG. 8). The head portion of the pair of bolts 302 rests flush with the top surface of the carton retainer plate 256 with the elongated stepped slot 286 functioning as a countersink arrangement. Loosening the pair of bolts 302 permits the middle guide to be adjusted longitudinally to cooperate with various sizes of corrugated cases that can be used in the machine.

The output guide 294 is irregular in shape, the top edge again being beveled and the lower portion thereof tapered as for the previous guides. The output guide 294 is somewhat larger than an output triangular mount 306, to which it is fixedly attached. The lower output corner of the output guide 294 is scalloped to provide a means for moving the output flap of the corrugated case 34 outwardly and will be discussed hereinafter. The attachment of the output guide 294 to the output triangular mount 306, and the output triangular mount 306 to the carton retainer plate 256, is similar to the attachment as previously described for the middle guide 292. Thus, the output guide 294 is longitudinally adjustable to cooperate with the various sizes of corrugated cases that can be used with the machine. The operation of the carton retainer plates 256 and the sets of flap guides 288 will be discussed more fully with respect to operation hereinafter.

The basket backstop 154 is shown in FIGS. 7, 8, 9 and 10, and incorporates a vertical mount plate 308 that is fixedly attached to the output surface of, and at the center span of the upper mount beam 156 by a set of three bolts 310. The vertical mount plate 308 rises vertically, and is strengthened in longitudinal bending by the rigid addition of a pair of side flanges 312. A horizontal mount plate 314 is fixedly attached across the upper input surface of the vertical mount plate 308 by a set of three bolts 316. A pair of cantilever mount tubes 318 is rigidly and spacedly affixed to the input face of the horizontal mount plate 314.

A backstop assembly 320 is comprised of a vertical beam 322, a face plate 324, and a sliding mount assembly 326. The face plate 324 is rigidly affixed to the input surface of the vertical beam 322 that is in turn rigidly affixed to the bottom surface of a bottom flange 328 of the sliding mount assembly 326. A spacer block 330 is rigidly and centrally affixed to the top surface of the bottom flange 328 and incorporates a pair of tapped holes 332 vertically and spacedly disposed therethrough. A top clamp 334, of the same dimensions as the bottom flange 328, incorporates a pair of clear holes 336, centrally and spacedly disposed therethrough and in vertical alignment with the pair of tapped holes 332 of the spacer block 330. Bolts 338 pass through the clear holes 336 of the top clamp 334 and threadably mount into the tapped holes 332, to clampedly attach the sliding mount assembly 326 to the pair of cantilever mount tubes 318. Note that the vertical dimension of the spacer block 330 is slightly smaller than the corresponding dimensions of the pair of cantilever mount tubes 318, and that its transverse dimension is a clearance fit smaller than the transverse distance between the pair of cantilever mount tubes 318, to facilitate clamping, sliding and lateral placement of the sliding mount assembly 326. A rug 340, of the same dimensions as the face plate 324, can be fixedly attached to the input surface of the face plate 324 if energy absorbing qualities are desired in the backstop assembly 320. The rug 340 is depicted in FIG. 5 only.

Figure 11:
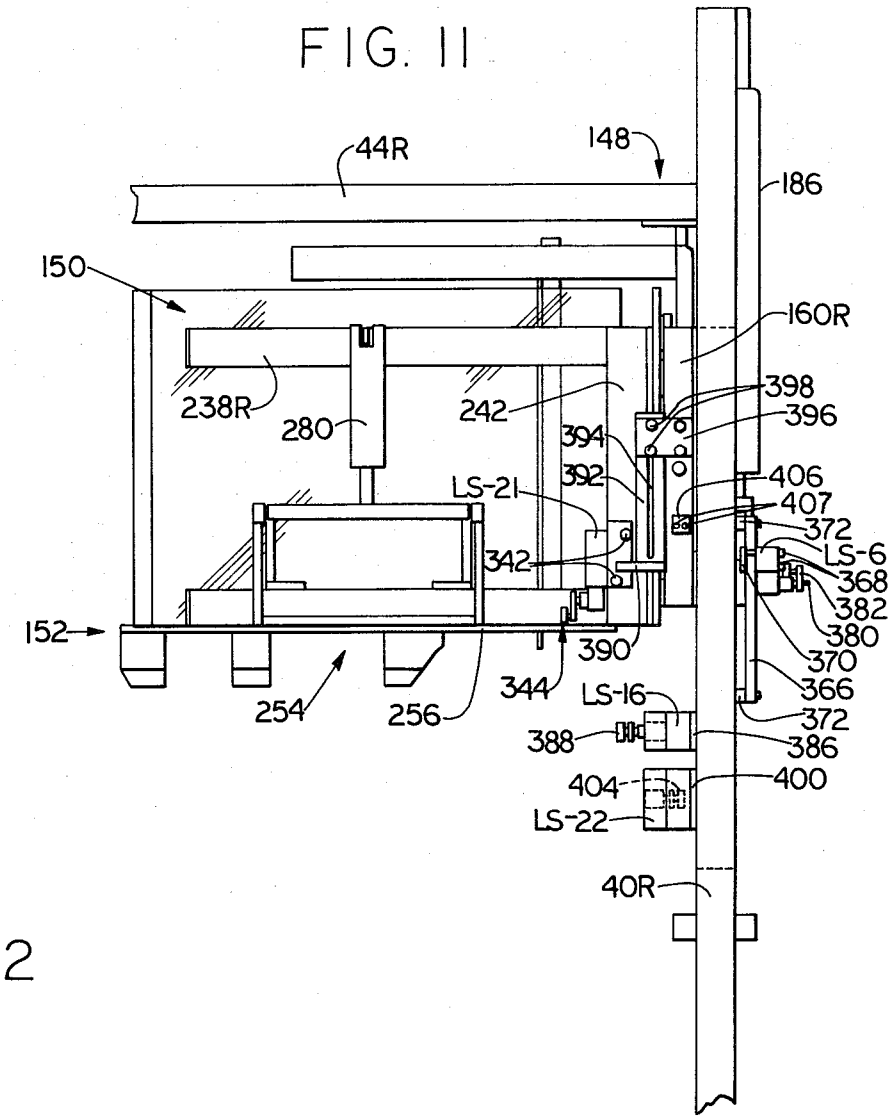
FIG. 11 is a fragmentary view in side elevation of the elevator section of the machine, taken in the direction of the arrows 11—11 in FIG. 3.

A limit switch LS-21 is shown in FIGS. 9, 10 and 11. The limit switch LS-21 is fixedly attached in an inverted disposition to the lower outboard surface of the vertical mount post 242 of the right hand side frame weldment 238R of the basket frame 150 by bolts 342. The bolts 342 pass through clear mounting holes in the body of the limit switch LS-21 and threadably mount in the vertical mount post 242. A switch arm and roller 344 is pivotally mounted within the head of the limit switch LS-21, and cooperates with the outboard edge of the carton retainer plate 256 of the right hand assembly 254 of the basket floor 152. As the cylinder rods 276 of the cylinders 280 of the basket floor 152 are retracted, the left and right hand assemblies 252 and 254, respectively, move outboardly as previously described, the right hand assembly 254 contacting the roller of the switch arm and roller 344 (FIG. 10) to rotate it counterclockwise, thereby making the appropriate circuit to indicate that the basket floor 152 is open.

A limit switch LS-1A and a limit switch LS-1 are shown in FIGS. 2 and 3. The limit switch LS-1A is fixedly attached to a slide block 346A and the limit switch LS-1 is likewise attached to a slide block 346. The slide blocks 346 and 346A are identical and are so constructed so as to encompass the inboard edge, output surface and outboard edge of a vertical slide rail 348. Both slide blocks 346 and 346A are retained upon the vertical slide rail 348 by a common retainer plate 350. The lower end of the common retainer plate 350 incorporates clear holes, through which a pair of bolts 352 (FIG. 2) passes to threadably mount into the slide block 346. The upper end of the common retainer plate 350 incorporates clear vertical slots, through which a pair of bolts 354 passes to threadably mount into the slide block 346A. This arrangement provides a degree of vertical adjustment, with respect to each other, for the limit switches LS-1 and LS-1A. The internal dimensional clearances of the slide blocks 346 and 346A and the common retainer plate 350 are such that free slidable movement upon the vertical slide rail 348 is provided. Frictional clamping of the slide blocks 346 and 346A upon the vertical slide rail 348 is provided by a wing bolt 356 (FIG. 2), that threadably passes through the lower portion of the common retainer plate 350 to bear against the input surface of the vertical slide rail 348, thus clampedly pulling the slide block 346 into frictional contact with the vertical slide rail 348. The lateral flanges of a pair of angle mounts 358 are fixedly attached to each end of the vertical slide mount 348. The longitudinal flanges of the pair of angle mounts 358 are fixedly attached to the outboard surface of the left hand output post 40L.

The limit switch LS-1A is inverted so that a switch arm and roller 360 thereof is in close working proximity to a switch arm and roller 362 of the limit switch LS-1. As the elevator assembly 20 is lowered, a trip 364 (FIG. 3) contacts the switch arm and roller 360 pivoting it counterclockwise. Thereafter, when a count switch (not shown in detail and associated with the carton assembling machine 12) is activated, a pack cycle can be instituted. In the event the count switch is not actuated, the limit switch LS-1, when made by the trip 364, starts the pack cycle. Therefore, position of the limit switch LS-1A sets a minimum height for a stack of cartons 32 required before a pack cycle is instituted, the limit switch LS-1 will pack a stack of maximum height, and the count switch can initiate a pack cycle for a stack of proper height and containing a predetermined number of cartons. The trip 364 is fixedly attached to the left hand output surface of the actuator bar 174 of the elevator structure 148. The operation will be described more fully hereinafter.

A limit switch LS-6 is shown in FIGS. 3 and 11. It is clampedly and adjustably mounted upon a short slide rail 366 by a pair of bolts 368. The pair of bolts 368 passes through clear mounting holes in the limit switch body, then passes by each side of the short slide rail 366 to threadably mount into a clamp plate 370 (FIG. 11). This provides a degree of vertical adjustment to the limit switch LS-6. The short slide rail 366 fixedly incorporates a pair of mount bars 372. Each member of the pair of mount bars 372 is fixedly attached to each end of the short slide rail 366 by a bolt 374, that passes through a clear hole in the short slide rail 366 and threadably mounts into the mount bar 372. Similarly, each member of the pair of mount bars 372 is fixedly attached to the output surface of the right hand output post 40R by a bolt 376. Perpendicular relationship between the short slide rail 366, the pair of mount bars 372 and the right hand output post 40R is provided by a pair of bolts 378. The pair of bolts 378 passes through clear holes in the short slide rail 366, through the pair of mount bars 372, to threadably mount into the output surface of the right hand output post 40R. The limit switch LS-6 is actuated by a switch trip 380 (FIG. 3) that comes into working contact with a switch arm and roller 382 as the elevator structure 148 ascends and descends. The switch trip 380 is a longitudinally oriented metal plate that is rigidly and perpendicularly affixed at its input end to a trip mount 384. The trip mount 384 is fixedly attached to the right hand output surface of the actuator bar 174 of the elevator structure 148. As the elevator structure 148 descends past the limit switch LS-6, no circuits are made. When the switch trip 380 ascends into working relationship with the switch arm and roller 382, rotating it counterclockwise, the limit switch LS-6 is made which makes the proper circuits to close the basket floor 152, and initiates carton flow and puts the elevator assembly 20 under control of the rate valve assembly 22. This will be described more fully in the discussion of the operation of the machine hereinafter.

A limit switch LS-16, shown in FIGS. 3 and 11, is fixedly attached to a mount plate 386 that is in turn fixedly attached at its inboard end to the input surface of the right hand output post 40R. A switch arm and roller 388 is pivotally mounted within the head of the limit switch LS-16, and comes into working contact with a switch trip 390 (FIG. 11). The switch trip 390 is a short metal bar that is longitudinally disposed and rigidly affixed to the bottom outboard edge of a vertical slide plate 392. The vertical slide plate 392 incorporates a slot 394 and is adjustably clamped between a trip mount 396 and a clamp plate (not visible in the figure) by a pair of bolts 398. The bolts 398 pass through clear holes in the input end of the trip mount 396, pass through the slot 394 and threadably mount into the clamp plate whose physical dimensions are that of the input half of the trip mount 396. The output end of the trip mount 396 is fixedly attached to the outboard surface of the right hand frame plate 160R of the elevator structure 148. In this manner, the switch trip 160 has a considerable degree of vertical adjustment. The limit switch LS-16 will shut off the feed of cartons by the carton assembling machine 12 to arrest descent of the elevator assembly if a corrugated case is not ready to receive a stack of cartons 32. This will be discussed more fully hereinafter.

A limit switch LS-22 is shown in FIGS. 3 and 11. The limit switch LS-22 is fixedly attached to a switch mount plate 400 that is in turn fixedly and adjustably attached, through the auspices of a slot 402 therein, to the input surface of the right hand output post 40R. A switch arm and roller 404 (FIG. 11) is pivotally attached within the head of the limit switch LS-22, and is actuated by a trip lug 406 that is fixedly attached to the lower right hand surface of the right hand frame plate 160R by a pair of countersunk bolts 407. The upper and lower edges of the trip lug 406 are rounded so that engagement of the inwardly disposed switch arm and roller 404 will be smooth. The actuation of the limit switch LS-22 makes the appropriate circuits that will open the basket floor 152. This will be more fully described hereinafter.

CARTON ASSEMBLING MACHINE

(Rate Valve Assembly)

Figure 13:
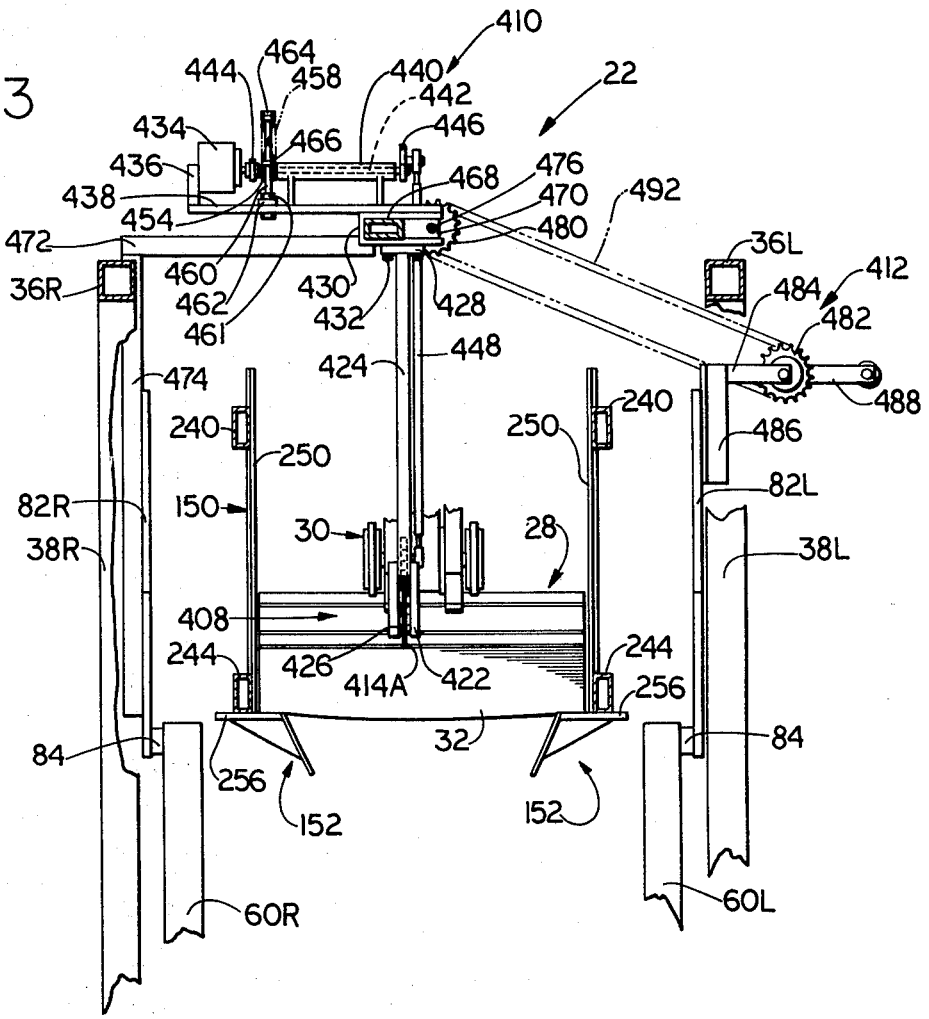
FIG. 13 is a partially schematic view in transverse section of the elevator section of the machine taken along line 13—13 in FIG. 5.

The rate valve assembly 22 is shown in FIGS. 5 and 13 and includes a sensing assembly 408, a valve assembly 410, and a mounting and adjustment assembly 412.

The sensing assembly 408 incorporates a sensing rod 414 that rides upon the top of the stack of cartons 32 that is being fed into the basket frame 150 of the elevator assembly 20. The sensing rod 414 is clampedly attached within an upper extension 416 of a rod pivot 418 (FIG. 5). The sensing rod 414 is shown in an unactuated position by solid line, and in its actuated position 414A is double-dot-dash line. The output end of the rod pivot 418 is pivotally mounted upon a pivot pin 420 that is in turn fixedly mounted through the input ends of a pair of sensor plates 422. The plates 422 are rigidly affixed in lateral spaced relationship upon the sides of and at the lower extremity of a vertical suspension bar 424. A stop bar 426 is rigidly affixed to the inner surfaces of the pair of sensor plates 422 adjacent the bottom edge thereof, to prevent the sensing rod 414 from pivoting downward beyond necessary limits. The top extremity of the vertical suspension bar 424 is rigidly affixed to the bottom surface of a mounting flange 428. The mounting flange 428 is fixedly attached to the lower surface of a slide bracket 430 by bolts 432 that pass through clear holes in each end of the mounting flange 428 and threadably mount in the slide bracket 430.

The valve assembly 410 incorporates a rate valve 434 that is fixedly attached to the left hand surface of a vertical mount plate 436 that is in turn fixedly attached upon the top surface of, and at the right hand edge of, a cantilever mount plate 438. Rigidly affixed to the top surface of the cantilever mount plate 438, and in axial alignment with the rate valve 434, is a bearing stand 440. The bearing stand 440 pivotally incorporates a shaft 442 that is fixedly attached to the shaft of the rate valve 434 by a shaft coupler 444. The inboard extremity of the shaft 442 fixedly incorporates a torque arm 446 that extends generally in the input direction. A series of holes 447 (FIG. 5) is incorporated along the length of, and adjacent the free end of, the torque arm 446 to provide a choice in attachment of the upper end of a turnbuckle rod 448. The lower end of the turnbuckle rod 448 is pivotally affixed to the input extremity of the rod pivot 418.

The outboard end of the shaft 442 is fixedly fitted through the center of a limiter arm 454. The input end of the limiter arm 454 incorporates a limit bolt 456 (FIG. 5) that is vertically disposed and threadably mounted therethrough, and functions as an "up" stop for the sensing assembly 408. The output end of the limiter arm 454 operates against a compression spring 458 that is coaxially mounted upon a spring shaft 460. The spring shaft 460 is perpendicularly and threadably mounted into the top output end of a cantilever shaft mount 462. The spring shaft 460 is fixedly locked into place within the cantilever shaft mount 462 by a lock nut 461. The cantilever shaft mount 462 is longitudinally disposed and fixedly attached upon the top surface of the cantilever mount plate 438. The spring shaft 460 passes vertically upward through a slot in the output end of the limiter arm 454. The top extremity of the spring shaft 460 incorporates a double nut arrangement 464 which confines the upper end of the compression spring 458, and the bottom end of which is restrained by a washer 466 that compressively rests against the top surface of, and overlaying the end slot of, the output end of the limiter arm 454. This arrangement puts a counterclockwise torque (FIG. 5) upon the shaft 442 which transfers into an upward thrust in the turnbuckle rod 448, pulling the rod pivot 416 upwardly, thus depressing the sensing rod 414 toward the stop bar 426.

The slide bracket 430 is of C-shape cross section as is seen in FIG. 13 and fits about the top, bottom and right side of a rectangular slide tube 468. The open end of the slide bracket 430, or the left side of the rectangular slide tube 468, is closed by a pusher block 470 that is fixedly attached between areas of the slide bracket 468. The input end of the rectangular slide tube 468 is rigidly affixed in a cantilever configuration upon the top left hand end of a pair of lateral mount tubes 472. The right hand end of the pair of lateral mount tubes 472 is rigidly affixed upon the top extremities of a pair of vertical mount tubes 474. The vertical mount tubes 474 are affixed to the outboard surface of the right hand mount plate 82R of the assembling machine framework 56.

The pusher block 470 of the rate valve assembly 22 is threadably mounted upon an adjustment screw 476 that is in turn rotatably mounted in spaced parallel relationship with the rectangular slide tube 468. The adjustment screw 476 integrally incorporates at each end thereof, a length of smaller diameter shaft that is rotably mounted in a clear hole in one of a pair of screw mounts 478. The screw mounts 478 are fixedly attached to extremities of the rectangular slide tube 468 and extend horizontally to the left therefrom. The input shaft extension of the adjustment screw 476 passes through its respective member of the pair of screw mounts 478 to fixedly incorporate a chain sprocket 480.

Laterally aligned to the left of the chain sprocket 480 is a crank sprocket 482 that is in turn rotatably mounted upon the left end of a lateral bar 484. The lateral bar 484 is rigidly affixed to the upper input surface of the lateral flange of a mount angle 486. The mount angle 486 is vertically disposed and its lower longitudinal flange is rigidly affixed upon the outboard surface of the left hand mount plate 82L of the assembling machine framework 56. Fixedly attached to the input face of the crank sprocket 482, through the intervening auspices of a crank spacer 490, in a crank handle 488. The presence of the crank spacer 490 allows the crank handle 488 to rotate without interference with the left hand mount plate 82L. A rate valve chain 492 circumscribes the chain sprocket 480 and the crank sprocket 482 so that, when the crank handle 488 is turned, the adjustment screw 476 is rotated to move the valve assembly 410 and the sensing assembly 408 in either direction as desired.

PACKING ASSEMBLY MACHINE

(Case Retaining Assembly)

The case retaining assembly 24 is shown in FIGS. 2, 3, 12, 15 and 16. Referring first to FIGS. 2 and 3, the case retaining assembly 24 includes a case table 494, a table guide assembly 496, and an upper case guide assembly 498.

Figure 16:
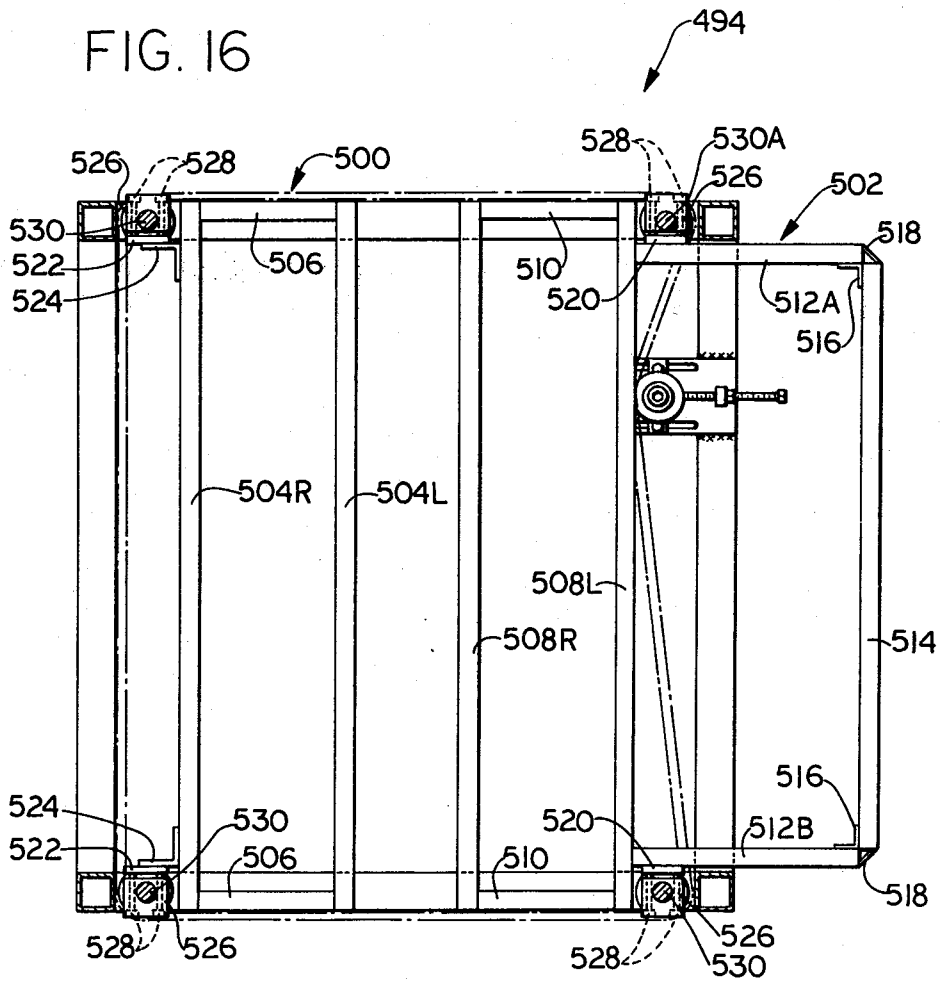
FIG. 16 is a fragmentary view in section of the lower portion of the case packing section of the machine showing the structural features of a case table without top sheeting, taken on the line 16—16 in FIG. 3.

As is shown most clearly in FIG. 16, the case table 494 incorporates a right hand table frame 500 and a left hand table frame 502. The right hand table frame 500 is comprised of longitudinal beams 504L and 504R and a pair of lateral beams 506. The longitudinal beams 504L and 504R are held in lateral and parallel spaced relationship by the lateral beams 506, which are rigidly affixed between the ends of the longitudinal beams 504L and 504R.

The left hand table frame 502 is comprised of longitudinal beams 508L and 508R, a pair of lateral beams 510, lateral extension beams 512A and 512B, and an outboard longitudinal beam 514. The longitudinal beams 508L and 508R are held in lateral and parallel spaced relationship by the pair of lateral beams 510 fixed between ends thereof. The lateral extension beams 512A and 512B are rigidly affixed at their inboard extremities to the outboard surface of the left hand longitudinal beam 508L and are set back somewhat from the input and output ends thereof. The outboard ends of the lateral extension beams 512A and 512B support a pair of mount angles 516, the lateral flanges thereof being rigidly affixed to the opposing surfaces of the lateral extension beams 512A and 512B, so that the longitudinal flanges of the mount angles 516 extend toward each other as shown in FIG. 16. The outboard longitudinal beam 514 is rigidly affixed to the outboard surfaces of the longitudinal flanges of the pair of mount angles 516 and is of such length so as not to cover the outboard extremities of the lateral extension beams 512A and 512B. A pair of corner plates 518 is rigidly affixed between the outer vertical edges of the lateral extension beams 512A and 512B and the input and output edges of the outboard longitudinal beam 514 so as to produce a mitered corner.

The left hand table frame 502 incorporates a pair of mount blocks 520 (FIGS. 2 and 16) that is rigidly affixed to the outer surfaces of the lateral extension beams 512A and 512B, adjacent to the left hand longitudinal beam 508L. The left hand table frame 500 incorporates a pair of mount blocks 522 that is of the same dimensions as the pair of mount blocks 520, rigidly affixed to the outer surfaces of transverse flanges of a pair of cantilever mount angles 524 (FIGS. 3 and 16). The longitudinal flanges of the cantilever mount angles 524 are rigidly affixed to the right hand surface of, and adjacent the ends of the right hand longitudinal beam 504R, such that the pair of mount blocks 520 and 522 are laterally aligned. Each member of the pairs of mount blocks 520 and 522 incorporates a threaded block 526 (FIGS. 2, 3 and 16). The threaded block 526 incorporates a pair of clear countersunk holes that passes longitudinally therethrough, and that receive a pair of long shoulder bolts 528 that threadably mount into the pair of mount blocks 520 and 522. The smooth shanks of the pair of long shoulder bolts 528 are longer than the longitudinal dimension of the threaded block 526, thereby giving a degree of longitudinal freedom to the threaded blocks 526.

The four threaded blocks 526 are threadably mounted upon a set of four threaded shafts 530. Each of the set of four threaded shafts 530 incorporates at each end thereof an appropriate length of clear shaft having a diameter smaller than that of the threaded portion thereof, so as to be rotatably mountable in bearings. The lower end of each threaded shaft 530 is horizontally and vertically bearinged in a flanged bushing 532 (FIGS. 2 and 3) that is in turn pressed into a clear bore within a bushing block 534. The bushing block 534 is fixedly attached upon the top of a mounting pad 536 that is in turn rigidly affixed to the top surface of, and appropriately placed upon the bottom input and output lateral beams 46 and 48, respectively.

Figure 15:
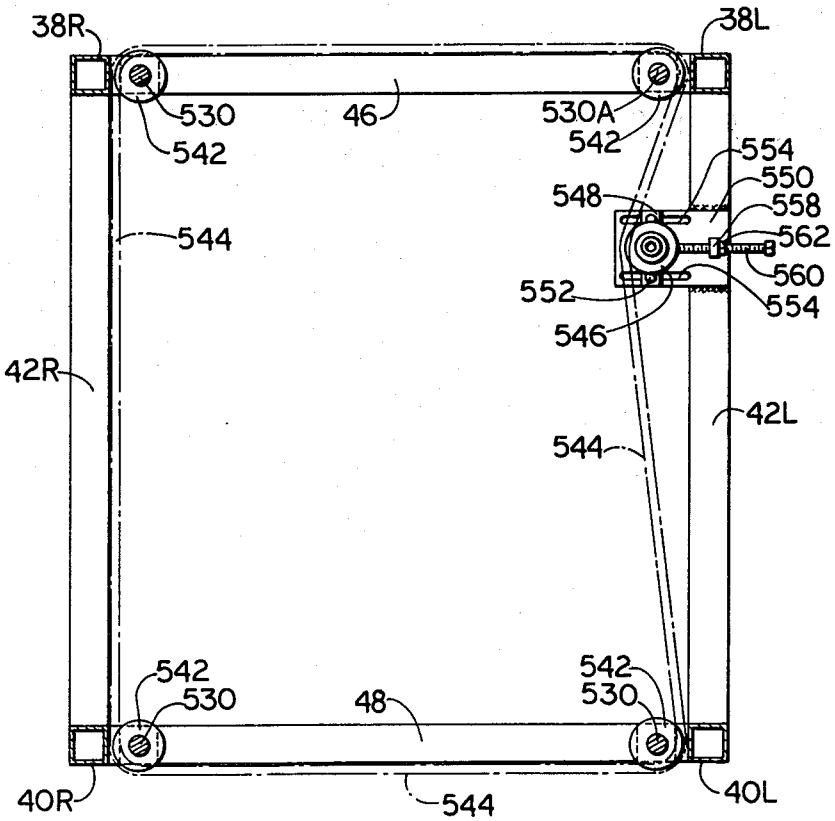
FIG. 15 is a fragmentary view in section of the lower portion of the case packing section of the machine, taken on the line 15—15 in FIG. 3.

The top extremity of each of the threaded shafts 530 is rotatably mounted in a bearing 538 that is in turn fixedly attached to a bearing mount 540. The four bearing mounts 540 are appropriately placed and rigidly affixed upon the inboard surfaces of the input posts 38L and 38R, and the output posts 40L and 40R. Referring now to FIGS. 2, 3 and 15, the set of four threaded shafts 530 each fixedly incorporates near its bottom end a chain sprocket 542. The four threaded shafts 530 are caused to rotate in unison by a floor chain 544 that circumscribes the four chain sprockets 542, as shown in FIG. 15. Tension is maintained in the floor chain 544 by a floor idler sprocket 546 that is rotatably mounted to a sprocket mount 548 (FIGS. 2 and 15). The sprocket mount 548 is clampedly attached upon the top of an idler base 550 by a pair of bolts 552. The pair of bolts 552 passes through clear holes in the sprocket mount 548, then through a pair of slots 554 in the idler base 550, to threadably mount into a clamp bar 556. The left end of the idler base 550 is fixedly attached across the top surface of the left hand bottom stringer 42L. A tension lug 558 is rigidly affixed upon the top surface of, and at the left end of the idler base 550, and threadably receives a tension bolt 560 that bears against the left side of the sprocket mount 548. When the tension bolt 560 is turned clockwise (FIG. 2) it advances, thus pushing the floor idler sprocket to the right to produce tension in the floor chain 544. The pair of bolts 552 can be tightened to clamp the sprocket mount 548 at the appropriate place along the pair of slots 554. The bearing position of the tension bolt 560 is assured by a lock nut 562.

Referring now to FIGS. 2 and 3, a cantilever crank mount 564 is rigidly affixed to the left hand surface of the left hand input post 38L approximately halfway up. A bearing block 566 is rigidly affixed upon the top surface of, and at the outboard extremity of the cantilever crank mount 564, and rotatably supports a crank sprocket 568. Fixedly attached to the top of the crank sprocket 568 is a crank arm and handle 570. A crank chain 572 circumscribes the crank sprocket 568 and an adjustment sprocket 574 that is in turn fixedly attached to the top end of the threaded shaft 530A of the set of four threaded shafts 530 that is adjacent to the left hand input post 38L. The crank chain 572 passes around the input and output sides of the left hand input post 38L without interference. As the crank arm and handle 570 is turned in the desired direction, the threaded rods 530 rotate in unison to raise or lower the left and right hand table frames 500 and 502 in unison. The case table 494 is constructed in two pieces to permit passage of the case discharge pusher 16 that will be discussed in detail hereinafter.

The right hand table frame 500 is covered with a sheetmetal cap 576 (FIG. 3). The sheetmetal cap 576 incorporates turned down edges that correspond with the outer perimeter of the right hand table frame 500. The left hand table frame 502 is also covered with a sheetmetal cap 578. Both sheetmetal caps 576 and 578 incorporate cutouts in their turned down edges to accommodate their respective pairs of mount blocks 522 and 520. A right hand angle rail 580 is rigidly affixed along the left hand edge of the sheetmetal cap 576, and a left hand angle rail 582 is rigidly affixed along the right hand edge of the sheetmetal cap 578, to narrow the lateral distance therebetween for the utilization of small corrugated cases that are not shown in the figures.

Figure 12:
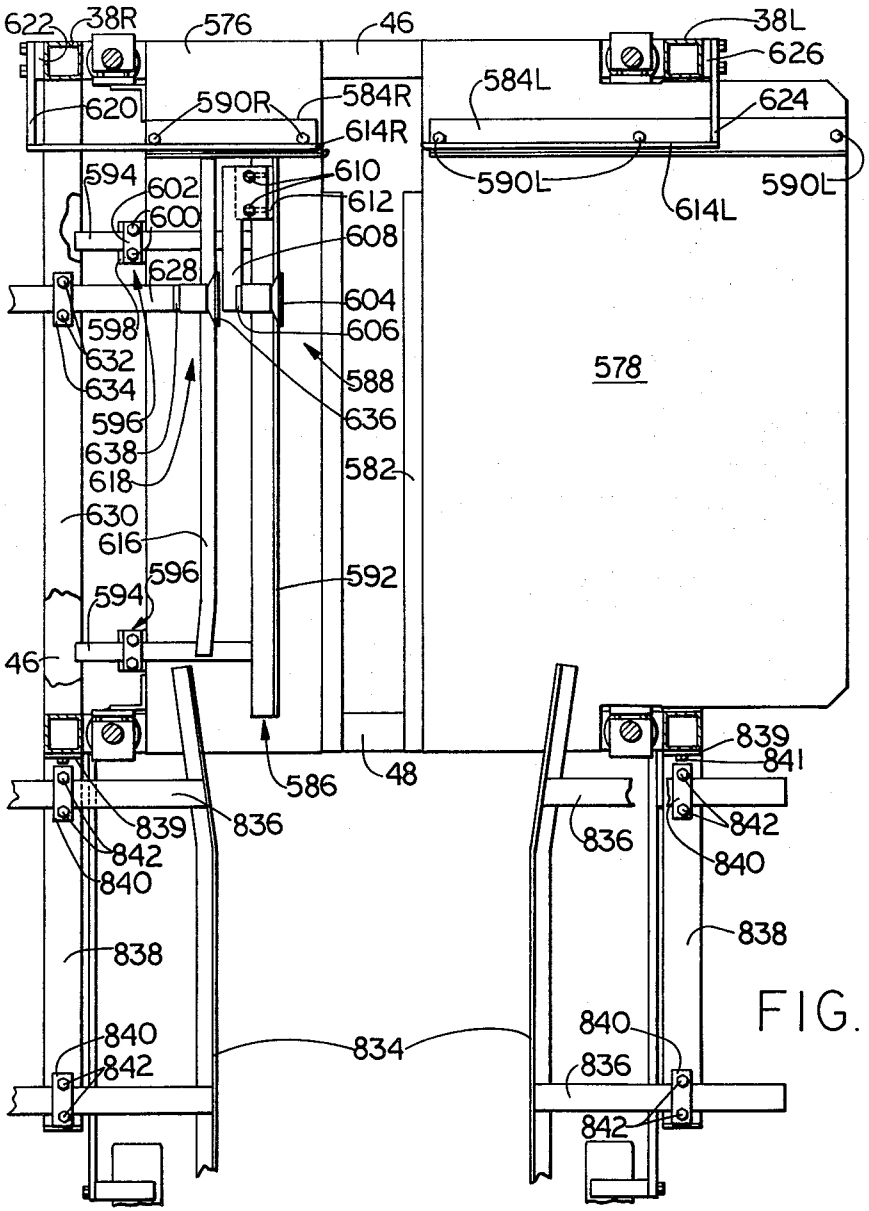
FIG. 12 is a fragmentary plan view of the case packing section of the machine, taken in section along the line 12—12 in FIG. 3, parts being partially cut away, in section, and out of operational adjustment for structural clarity, one of a pair of vacuum cup assemblies being displaced from operating position.

The table guide assembly 496 is shown in FIGS. 2, 3 and 12 and incorporates transverse corrugated guides 584L and 584R, a lateral stop assembly 586, and a bottom vacuum retainer assembly 588. The right hand transverse corrugated guide 584R is an angle iron whose left hand extremity is rolled backward toward the input end of the carton packing machine 10. It is held securely in place upon the top of the sheetmetal cap 576 of the right hand table frame 500 by a pair of bolts 590R. The rolled left hand end of the right hand transverse corrugated guide 584R prevents gouging of corrugated cases 34 as they are placed into the machine. The left hand transverse corrugated guide 584L is also an angle iron of longer dimension, fixedly held in place upon the top of the sheetmetal cap 578 of the left hand table frame 502 by a set of three bolts 590L. The transverse corrugated guides 584L and 584R are in lateral alignment, and so mounted that their horizontal flanges are turned in the input direction.

The lateral stop assembly 586 (FIGS. 2, 3, and 12) includes a lateral stop 592 and a pair of slide bars 594. The lateral stop 592 is longitudinally oriented with its horizontal flange extending outboardly and its vertical flange extending upwardly. The lateral stop 592 is rigidly affixed across the top of the left extremities of the pair of slide bars 594, each member of the pair being attached near one of the ends of the lateral stop 592. The free extremities of the slide bars 594 are clampedly held in a pair of clamps 596. Each of the clamps 596 includes a mount angle 598 whose vertical flange extends downwardly, and is rigidly affixed to the outboard surface of the right hand longitudinal beam 504R of the right hand table frame 500. A pair of bolts 600 passes downwardly through clear holes in a clamp bar 602, passes alongside the slide bar 594, and threadably mounts into the top of the horizontal flange of the mount angle 598. In this manner, the lateral position of the lateral stop 592 can be adjusted to cooperate with whatever size corrugated case is being used.

The bottom vacuum retainer assembly 588 incorporates a vacuum cup 604 that is fixedly attached to the top left hand surface of a cup riser 606 that is in turn rigidly affixed in an upright orientation upon the left hand output edge of an adjusting arm 608. The input end of the adjusting arm 608 is wider than the output end thereof to accommodate a pair of clamping bolts 610. The clamping bolts 610 pass through clear holes in the adjusting arm 608, through laterally disposed slots in the horizontal flange of a vacuum mount angle 612, to threadably mount into a clamp bar 613. The vertical flange of the vacuum mount angle 612 is rigidly affixed to the outboard surface of, and at the input end of, the vertical flange of the lateral stop 592. The vacuum cup 604 can be finely adjusted so as to be best situated to engage the side of the corrugated case 34 as it is placed into the machine.

The upper case guide assembly 498 is comprised of lateral guide rails 614L and 614R, a lateral stop bar 616, and an upper vacuum assembly 618. The right hand extremity of the right hand lateral guide rail 614R is rigidly affixed to the output end of a rail mount 620 (FIG. 12) that is in turn fixedly attached at its input end to the outboard surface of the right hand input post 38R through the interspacing auspices of a spacer block 622. The left hand extremity of the left hand guide rail 614L is rigidly affixed to the output end of a rail mount 624 that is in turn fixedly attached at its input end to the outboard surface of the left hand input post 38L through the interspacing auspices of a spacer block 626.

The lateral stop bar 616 is longitudinally disposed and is rigidly affixed across the left end of a lateral adjustment bar 628. The lateral adjustment bar 628 is clampedly mounted across the top surface of a longitudinal mount tube 630 that is in turn rigidly affixed between the right hand input and output post 38R and 40R, respectively. A pair of bolts 632 passes downwardly through clear holes in a clamp plate 634, passes alongside the lateral adjustment bar 628, and threadably mounts into the top surface of the longitudinal mount tube 630. Thus, the lateral stop bar 616 can be adjusted so as to properly work against the upper confines of the corrugated case 34 as it is placed into the machine.

The upper vacuum assembly 618 is comprised of a vacuum cup 636 that is fixedly mounted to the inboard surface of a cup riser 638 that is in turn rigidly affixed upon the top of, and near the left hand end of the lateral adjustment bar 628. In this manner, the vacuum cup 636 is in fixed working relationship with the lateral stop bar 616.

Operative relationship of the vacuum cups 604 and 636 is shown in FIG. 3 in position for holding the case 34. In FIG. 12, the lower vacuum cup 604 and the lateral stop 592 are shown displaced from operative position for ease of explanation.

CARTON PACKING MACHINE

(Packing Assembly Operation)

The operation of the packing assembly 14 of the carton packing machine 10 will be described herein with respect to FIGS. 1, 3, 5, 11, 13, 14 and 17. The operator stands on the left side of the carton packing machine 10 (FIG. 1) and prepares the assembled corrugated case 34 for insertion into the packing assembly 14. In so doing, he grasps top flaps 35A, 35B, 35C and 35D and bends them outwardly to a near horizontal position, then upon release the flaps return to the outwardly open position shown in FIGS. 1 and 17. The operator places the corrugated case 34 on the left hand portion of the case retaining assembly 24, as is shown in double-dot-dash line in FIG. 17, and moves it into parallel alignment against the left hand transverse corrugated guide 584L and the left hand lateral guide rail 614L. As the corrugated case 34 moves transversely into the machine, it comes into parallel guided relationship with the right hand transverse corrugated guide 584R and the right hand lateral guide rail 614R before coming to a halt against the lateral stop 592 and the lateral stop bar 616. The operator depresses a start button SW-10 (FIG. 25), which makes appropriate circuits to connect the vacuum cups 636 and 604 to a source of vacuum. The vacuum cups 636 and 604 hold the corrugated case 34 in fixed relationship against the aforementioned guides and stops as is shown in solid line in FIG. 17.

Figure 14:
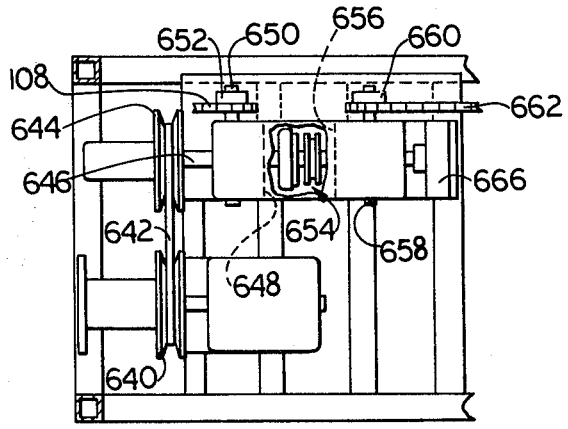
FIG. 14 is a fragmentary plan view of the main power section of a carton assembling portion of the machine taken along line 14—14 in FIG. 1, parts partially cut away and in section for structural clarity.

A motor M-3 (FIGS. 1 and 14) powers the belt conveyor 87 and a main carriage assembly 664 of the carton assembling machine 12. The motor M-3 drives a trim pulley 640 which drives a belt 642 to drive a second drive pulley 644. The pulleys 640 and 644 and the belt 642 form an adjustable speed drive for a shaft 646 on which the pulley 644 is mounted. The shaft 646 also drives gears (not shown in detail) in a gear housing 648 to drive a shaft 650 which drives a sprocket 652 to drive the drive chain 108 and cause driving of the belt conveyor 87 and the nip roll assembly 30. The shaft 646 also drives a clutch 654 (FIG. 14). When the clutch 654 is actuated, gears (not shown) in a gear box 656 drive a shaft 658 to drive a sprocket 660, which drives a chain 662, which drives the main carrier assembly 664. When the clutch 654 is deactivated, a brake 666 is actuated to prevent drive of the main carrier assembly 664.

The procession or stream of flattened cartons 28 passes from right to left of FIG. 1 out of the main carrier assembly 664 onto the belt conveyor 87. As the stream advances, the cartons can be counted by appropriate counting mechanism, not shown in detail, which actuates a count switch 1761 (FIG. 25) when a predetermined number of cartons has been advanced to the conveyor belt 87. The procession of flattened cartons 28 passes from right to left of the belt conveyor 87, and is ejected into the packing assembly 14 by the nip roll assembly 30.

Each carton 29 is deflected slightly downward by the elongated leaf springs 142 of the nip roll assembly 30 (FIG. 5) proceeds forwardly to pass under the sensing rod 414, its forward motion being halted by the backstop assembly 320, and comes to rest in the stack 32 upon the basket floor 152. As can be seen in FIG. 13, the procession of flattened cartons 28 enters narrowly between the pair of side guide plates 250, and the stack of cartons 32 is suspended laterally across the carton retainer plates 256 of the basket floor 152. Large cartons will sag to some degree as indicated. The basket floor 152 of the elevator assembly 20 is moved downward under control of the rate valve assembly to keep the top of the stack of cartons 32 at a constant vertical height under the sensing rod 414.

Referring now to FIG. 3, the elevator assembly 20 will move downwardly to bring the trip 364 into working contact with the limit switch LS-1A. Until the limit switch LS-1A is actuated, the packing cycle, which causes discharge of the cartons from the elevator assembly 20, cannot be initiated. Once the limit switch LS-1A is actuated, the circuitry, to be described in greater detail hereinafter, is prepared to initiate the packing cycle when the count switch 1761 (FIG. 25) is actuated. If the count switch 1761 is not actuated, the elevator assembly 20 continues downward under the control of the rate valve assembly 22 until the trip 364 comes into working contact with the limit switch LS-1, and the limit switch LS-1 initiates the pack cycle. In summary, the limit switch LS-1A provides a minimum stack size, the count switch can provide a stack containing a predetermined number of cartons, and the limit switch LS-1 provides a maximum stack size. Initiation of the pack cycle stops the main carrier assembly 664.

When the pack cycle is initiated, the elevator assembly 20 is released from control of the rate valve 22 and advances downwardly to full stroke of the cylinder 186, whereupon the limit switch LS-22 is actuated by the trip lug 406 (FIG. 11).

The full down position of the elevator assembly 20 is shown in dot-dash line in FIGS. 1 and 3. The sets of flap guides 288 protrude into the upper confines of the corrugated case 34, the input guides 290 forcing the input flap 35A outwardly in the input direction by virtue of the angled input corners. Similarly, the output guides 294 (FIG. 1) force the output flap 35B outwardly in the output direction by virtue of the scalloped output corners thereof. In combination, the input and output guides 35A and 35B, respectively, can make slight longitudinal adjustments in the positioning of the upper opening of the corrugated case 34. As shown in FIG. 3, the input, middle and output triangular mounts 296, 304 and 306 can perform as flap spreaders for the left and right hand flaps 35D and 35C, respectively. This begins the process of moving these flaps from the solid line positions to that of the triple dot-dash line position as shown.

The limit switch LS-22, when actuated, makes the appropriate circuitry and pneumatic systems to retract the cylinders 280 (FIG. 10), thus opening the basket floor 152 to the triple dot-dash position that is indicated in FIG. 3. The opening of the basket floor 152 completes the spreading of the left and right hand flaps 35D and 35C, respectively, as shown. The lower tapered edges of the input, middle, and output guides 290, 292 and 294, respectively, come to rest momentarily against the inside surfaces of the upper sides of the corrugated case 34, insuring that the falling stack of cartons 32 enters without interference into the corrugated case 34.

The limit switch LS-21 (FIG. 10) is actuated when the basket floor 152 is open. The limit switch LS-21 makes the appropriate circuitry to command the elevator assembly 20 to move to its up position.

As the elevator assembly 20 approaches its up position, the limit switch LS-6 (FIG. 3) is actuated by the switch trip 380, making the appropriate circuitry to close the basket floor 152. As the basket floor closes, control of the elevator assembly 20 is transferred to the rate valve assembly 22, the main carriage assembly 664 is started to advance cartons to the belt conveyor 87, the case discharge pusher 16 is caused to advance and the vacuum at cups 604 and 636 is terminated. Note that the limit switch LS-6 is vertically adjustable so that it can be set to start the fill cycle before the elevator assembly 20 has reached its full up position, thus increasing the output of the machine. As will be described hereinafter, limit switches LS-5 and LS-3 indicate the discharge pusher in full forward and full back positions.

Figure 27:
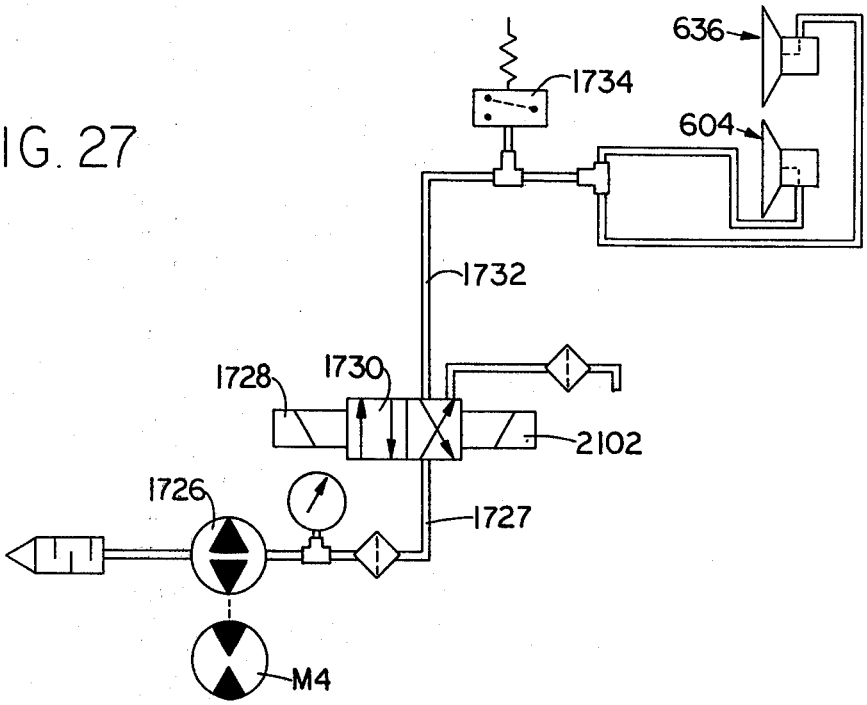
FIG. 27 is a schematic view of vacuum connections of the machine.

With the main carriage assembly 664 running, the elevator assembly 20 begins another fill cycle and the elevator moves downwardly under control of the rate valve assembly 22. The switch trip 390 (FIG. 11) actuates the limit switch LS-16 after a partial fill. Actuation of the limit switch LS-16 can stop the main conveyor assembly 664 if the case discharge pusher 16 has not returned to its retracted position to actuate the limit switch LS-3, or if a vacuum switch 1734 (FIG. 27) to be described in greater detail hereinafter has not been actuated to indicate a case in position and held by the vacuum cups 604 and 636. To provide continuous operation at the time of actuation of the limit switch LS-16 of the carton packing machine 10, the operator manually places a corrugated case 34 in proper position in the case retaining assembly 26 and depresses a vacuum pushbutton SW-10 (FIG. 25) before the elevator assembly 20 reaches the limit switch LS-16. The circuitry will be described in greater detail hereinafter.

CARTON PACKING MACHINE

Case Discharge Pusher

The case discharge pusher 16 is shown in FIGS. 4, 18, 19 and 20. The case discharge pusher 16 includes a pusher face assembly 670, a ram assembly 672, a support assembly 674, a scissors assembly 676, and an actuator assembly 678.

The pusher face assembly 670 is comprised of a tube 680, capped at both ends, that incorporates a pair of mounting plates 682 rigidly affixed to the sides thereof and extending in the input direction therefrom. Each member of the pair of mounting plates 682 incorporates a pair of holes 684 to facilitate mounting to the ram assembly 672.

Figure 18:
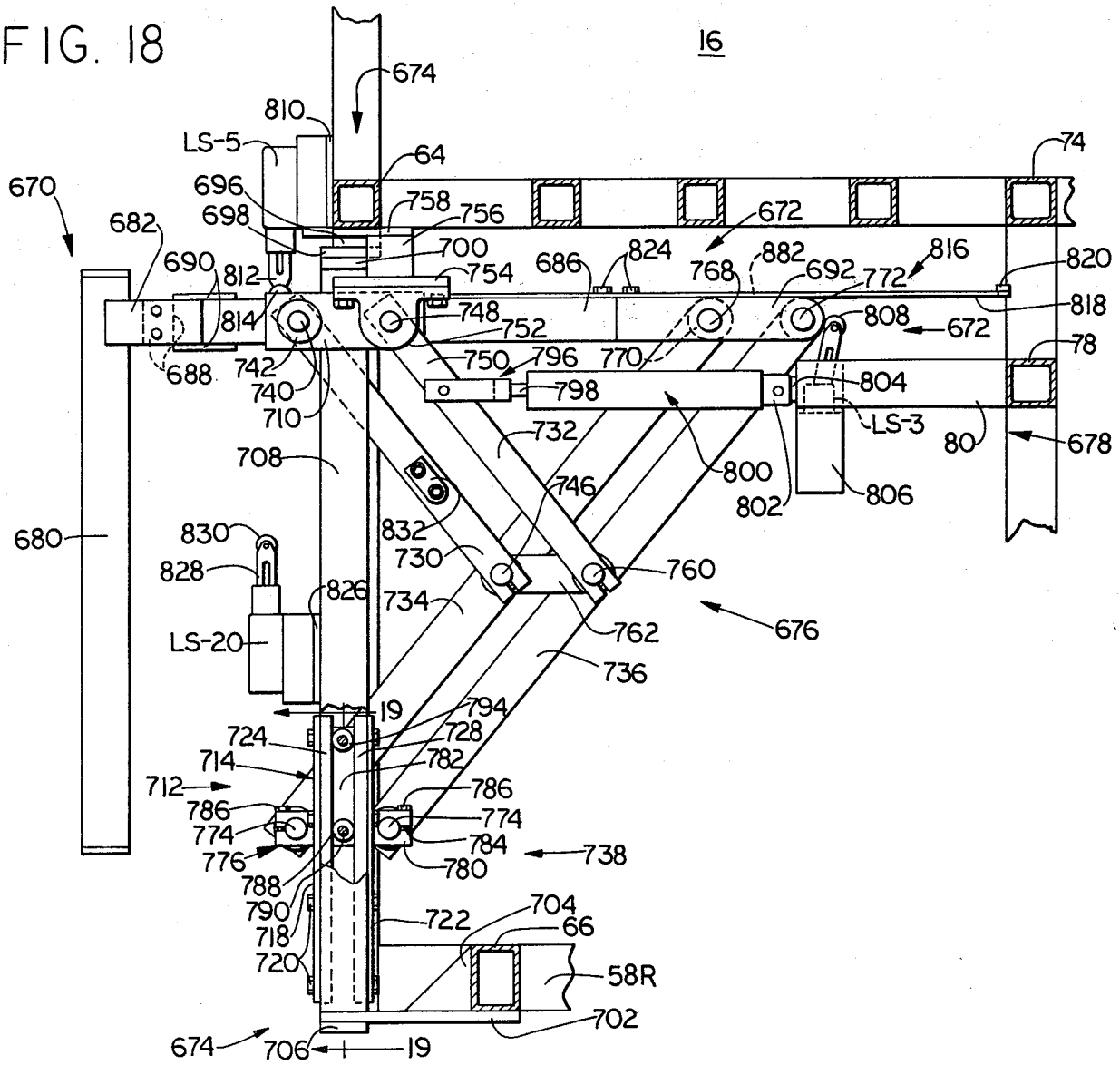
FIG. 18 is a view in longitudinal upright section showing the pusher section of the machine.

The ram assembly 672 includes a ram 686 as is shown in FIGS. 4 and 18. The ram 686 is a tubular member of rectangular cross section that incorporates upon its outboard sides, and at the output end thereof, a pair of mount blocks 688. Brace plates 690 are rigidly affixed to the top and bottom output surfaces of the ram 686 in such position that the output edges thereof lie in the same vertical plane as the input edges of the pair of mount blocks 688. Fasteners 689 extend through the holes 684 to be received in threaded sockets 691 in the mount blocks 688 to attach the pusher face assembly 670 to the ram assembly 672. The brace plates 690 provide a restraining torque to the mounting plates 682 to aid in proper vertical alignment of the pusher face assembly 670. The input end of the ram 686 incorporates a pair of tines 692 rigidly affixed to the sides thereof through the interspacing auspices of a pair of shims 694 (FIG. 4) to form a forklike structure that extends in the input direction therefrom.

Figure 20:
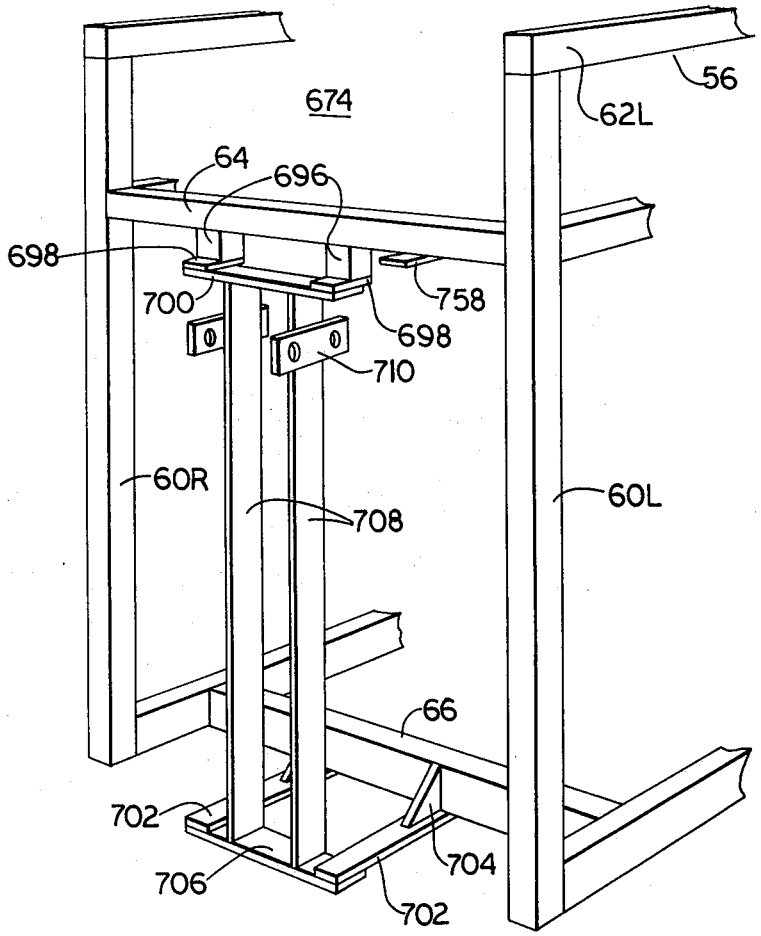
FIG. 20 is a fragmentary perspective view of a pusher frame assembly of the machine.

The ram assembly 672 is movable horizontally and in both longitudinal directions by virtue of the scissors assembly 676 (FIG. 18). The scissors assembly 676 is mounted on the support assembly 674. The support assembly 674 is shown in FIGS. 4, 18 and 20 and includes a pair of top hanger supports 696 rigidly affixed to the bottom surfaces of the upper output transverse beam 64 of the assembling machine framework 56. A bottom end plate 698 is rigidly affixed to the lower extremity of each of the top hanger supports 696. The bottom end plates 698 extend slightly in the output direction from the top hanger supports 696. A top lateral mount plate 700 is rigidly affixed under the two bottom end plates 698 and adjacent to the output edges thereof, so that the top lateral mount plate 700 is longitudinally offset in the output direction from the upper output transverse beam 64.

The support assembly 674 also incorporates a pair of bottom standoff mounts 702 rigidly affixed to the underside of the base transverse beam 66 and extending in the output direction therefrom. The lateral placement of the bottom standoff mounts 702 is such that they are directly below the top hanger supports 696. The output edges of the bottom standoff mounts 702 and the two bottom end plates 698 are in the same vertical plane. The horizontal orientation of the bottom standoff mounts 702 is assured by a pair of gussets 704 (FIG. 18) rigidly affixed between the top surface of the pair of bottom standoff mounts 702 and the output face of the base transverse beam 66. A bottom lateral mount plate 706 is rigidly affixed across the bottom output surfaces of the bottom standoff mounts 702, and is longitudinally placed to be directly below the top lateral mountplate 700. A pair of pusher riser plates 708 is rigidly affixed between the top and bottom lateral mount plates 700 and 706, respectively, in such position that the lateral distance between them will receive the scissors assembly 676 of the case discharge pusher 16. Also incorporated into the support assembly 674 is a pair of top pivot plates 710 (FIGS. 4, 18 and 20). The top pivot plates 710 are rigidly affixed across the outboard surfaces of the pair of pusher riser plates 708 near the top thereof.

Figure 19:
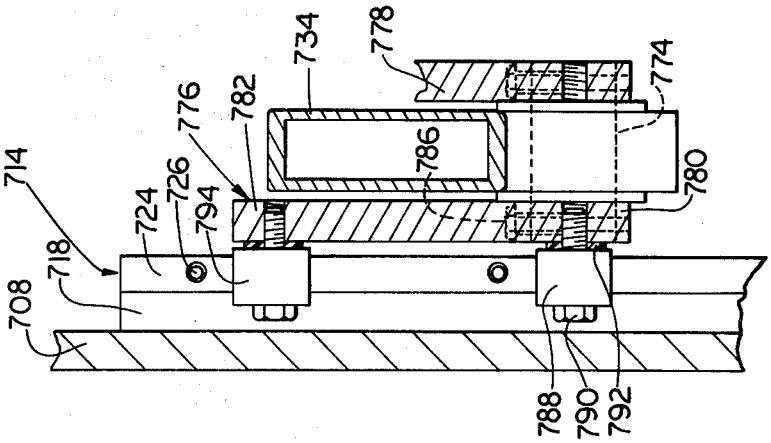
FIG. 19 is an upright sectional view taken on the line 19—19 in FIG. 18.

Near the bottom of the pair of pusher riser plates 708 is a cam roll guide assembly 712 that is shown in FIGS. 4, 18 and 19. The cam roll guide assembly 712 is comprised of a left hand guide 714 and a right hand guide 716 that are identical save for mirror image orientation. The left hand guide 714 includes an output lateral plate 718, fixedly attached to the output edge of, and extending inwardly from the left hand member of the pair of pusher riser plates 708. Four bolts 720 pass through clear holes in the output lateral plate 718 and threadably mount into the output edge of the left hand member of the pair of pusher riser plates 708, as is seen in FIG. 4. An input lateral plate 722, identical to the output lateral plate 718, is fixedly attached to the input edge of the left hand member of the pair of pusher riser plates 708 in the same manner as the output lateral plate 718. An output guide rail 724 is fixedly attached in a vertical disposition to the input surface of, and adjacent the inboard edge of the output lateral plate 718. Four bolts 726 (FIGS. 4 and 19) pass through clear holes in the inboard edge of the output lateral plate 718 and threadably mount into the output guide rail 724. Opposedly mounted from the output guide rail 724 and upon the input lateral plate 722 is an input guide rail 728. The input guide rail 728 is fixedly attached to the input lateral plate 722 in substantially the same manner as that of the output guide rail 724.

The top pivot plates 710 and the cam roll guide assembly 712 function as mounting points for the scissors assembly 676 that carries the ram assembly 672. The scissors assembly 676 (FIGS. 4, 18 and 19) incorporates a pair of output radius arms 730, a pair of input radius arms 732, an output carrier arm 734, an input carrier arm 736, and a cam roll mount assembly 738. The output radius arms 730 are pivotally attached to the output extensions of the top pivot plates 710, as shown most clearly in FIGS. 4 and 18. Upper ends of the output radius arms 730 are clampedly mounted upon the inboard ends of a pair of short output pivot shafts 740. The short output pivot shafts 740 are pivotally mounted in output bushings 742, which are fixedly attached within the output extensions of the pair of top pivot plates 710. Proper lateral spacing between the output radius arms 730 and the output extensions of the pair of top pivot plates 710 is maintained by a pair of coaxial spacers 744 (FIG. 4), mounted upon the pair of short output pivot shafts 740. The pair of short output pivot shafts 740 and the pair of output bushings 742 are held in lateral placement within the pair of top pivot plates 710 by appropriate lock rings that are not shown. The lower ends of the pair of output radius arms 730 are fixedly clamped to the ends of an output middle shaft 746 (FIG. 18).

The upper ends of the pair of input radius arms 732 are pivotally mounted within the input extensions of the pair of top pivot plates 710 in the same manner as just described for the output radius arms 730 except for a left hand input pivot shaft 748. The left hand input pivot shaft 748 extends laterally to the left of the case discharge assembly 16 to carry an actuator arm 750 and to be pivotally mounted in a bearing 752. The bearing 752 is fixedly attached in an inverted position to the bottom surface of a bearing mount plate 754 that is in turn rigidly affixed to the bottom extremity of a bearing hanger 756. The bearing hanger 756 is rigidly affixed to the bottom surface of, and at the input end of an offset plate 758 (FIGS. 18 and 20). The offset plate 758 is rigidly affixed to the underside of the upper output transverse beam 64. The lower ends of the pair of input radius arms 732 are fixedly clamped to the ends of an input middle shaft 760 (FIG. 18).

The longitudinal distance between the output and input middle shafts 746 and 760, respectively, is maintained by a pair of longitudinal links 762. The longitudinal links 762 are pivotally mounted upon the shafts, as shown in FIGS. 4 and 18, are laterally placed thereupon to be adjacent the inboard surfaces of the pairs of input and output radius arms 732 and 730, respectively, with the interspacing auspices of a set of four spacers 764.

The output carrier arm 734 is pivotally mounted upon the central portion of the output middle shaft 746 and is laterally determined thereupon by a pair of output middle spacers 766 (FIG. 4) that work against the inboard surfaces of the pair of longitudinal links 762. The upper end of the output carrier arm 734 is pivotally mounted upon an output ram shaft 768, that is in turn fixedly held at each end within the pair of tines 692 of the ram assembly 672. The output carrier arm 734 is laterally determined upon the output ram shaft 768 by the interspacing auspices of a pair of upper output spacers 770. The input carrier arm 736 is pivotally mounted upon the central portion of the input middle shaft 760, and an input ram shaft 772, in the same manner as has just been described for the output carrier arm 734.

The lower ends of the input carrier arm 736 and the output carrier arm 734 are pivotally mounted upon the central portions of a pair of bottom shafts 774 as is shown in FIGS. 18 and 19. Each of the pair of bottom shafts 774 is fixedly clamped at its ends in the cam roll mount assembly 738. More specifically, the cam roll mount assembly 738 is comprised of a left hand roller mount 776 (FIGS. 4, 18 and 19) and a right hand roller mount 778 (FIG. 4). The left and right hand roller mounts 776 and 778, respectively, are identical except for their mirror image installation, therefore, only the left hand roller mount 776 will be discussed in detail.

The left hand roller mount 776 is of inverted T-shape and includes a horizontal cross bar portion 780 and a vertical support stem portion 782. As previously indicated, the left ends of the pair of bottom shafts 774 are clampedly held in clamp bores that are adjacent each end of the horizontal cross bar portion 780 provided with end slits 784 and a pair of clamp bolts 786. A bottom cam roll 788 is rotatably mounted upon a cam bolt 790, that is in turn threadably mounted in the center of the left hand face of the horizontal cross bar portion 780. As is seen in FIG. 19, a washer 792 insures free rotation of the cam roll 788 by spacedly holding its hub away from the horizontal suport member 780. An upper cam roll 794 is rotatably mounted at the top of the left hand surface of the vertical support member 782 in the same manner as that just described for the bottom cam roll 788. The bottom and upper cam rolls 788 and 794, respectively, are in vertical alignment and run within the confined vertical space provided by the output and input guide rails 724 and 728, respectively. The bottom and upper cam rolls 788 and 794, respectively, resist torque loads that would tend to displace the cross bar portion 780 from its horizontal orientation. Since the pair of bottom shafts 744 is held in a horizontal plane, and the output and input ram shafts 768 and 772 are also held in a horizontal plane, the ram 686 is likewise held in a horizontal plane.

The actuator arm 750, that is fixedly attached to the left hand input pivot shaft 748, pivotally supports upon its free extremity an actuator yoke 796, as is shown in FIGS. 4 and 18. The base of the actuator yoke 796 is threadably mounted upon the extended extremity of a piston rod 798 of a hydraulic cylinder 800. The base of the hydraulic cylinder 800 carries a mounting yoke 802. The mounting yoke 802 is pivotally mounted on a cylinder mount lug 804, that is in turn rigidly affixed to the output extremity of the actuator mount beam 80 of the assembling machine framework 56.

The limit switch LS-3 is fixedly attached to the right hand surface of a hanger mount 806, that is in turn rigidly affixed at its upper end to the right hand surface of, and at the output end of, the actuator mount beam 80, as is shown in FIGS. 4 and 18. The limit switch LS-3 is in an upright orientation, such that a switch arm and roller 808 thereof comes in contact with the upper input end of the input carrier arm 736 when the ram assembly 672 is in its retracted position.

The limit switch LS-5 (FIG. 18) is fixedly attached in an inverted orientation to the output face of a switch mount 810, that is in turn rigidly affixed at its lower end to the output face of the upper output transverse beam 64 of the assembling machine framework 56. The head of the limit switch LS-5 incorporates a switch arm 812 and a switch roller 814. The limit switch LS-5 is laterally disposed upon the upper output transverse beam 64 so that the switch roller 814 is suspended above the right hand roller mount 778 of the cam roll mount assembly 738. The limit switch LS-5 is not shown in FIG. 4, but its lateral placement can be understood therefrom. The switch roller 814 is vertically placed to cooperate with a switch actuator 816 shown in side view in FIG. 18 and in double dot-dash top view in FIG. 4. The switch actuator 816 is comprised of an adjustment plate 818 and an actuator lobe 820. The actuator lobe 820 is rigidly affixed laterally across the top input end of the adjustment plate 818 so that it extends slightly to the right thereof. The adjustment plate 818 incorporates a long slot 822 for longitudinally adjusting the actuator lobe 820. A pair of adjustment bolts 824 passes cleanly through the long slot 822 and threadably mounts into the top input end of the ram 686 for clampedly holding the adjustment plate 818 thereto. The switch actuator 816 is thereby capable of large longitudinal adjustments, whereby the forward travel of the pusher face assembly 670 can be adjusted over a wide range.

A limit switch LS-20 is shown in FIG. 18. It is fixedly attached to a mount plate 826 that is in turn rigidly affixed across the output edge of the left hand member of the pair of pusher riser plates 708. The mount plate 826 is laterally positioned upon the left hand member of the pair of pusher riser plates 708 so that a switch arm 828 and a switch roller 830 cooperate with a switch lug 832. The switch lug 832 is fixedly attached to the outboard surface of the left hand member of the pair of output radius arms 730, as shown in FIG. 18, and partially in FIG. 4. As the pusher assembly 16 moves the ram 686 in the output direction, or forward, the switch lug 832 swings through an arc which intersects the switch roller 830. The switch arm 828 rotates in the counterclockwise direction (FIG. 18) to allow the switch lug 832 to pass as the ram 686 travels forward to its full position. As the ram 686 returns, the switch lug 832 again intercepts the switch roller 830, rotating the switch arm 828 clockwise. The limit switch LS-20 is inactive in the machine of this invention.

Figure 17:
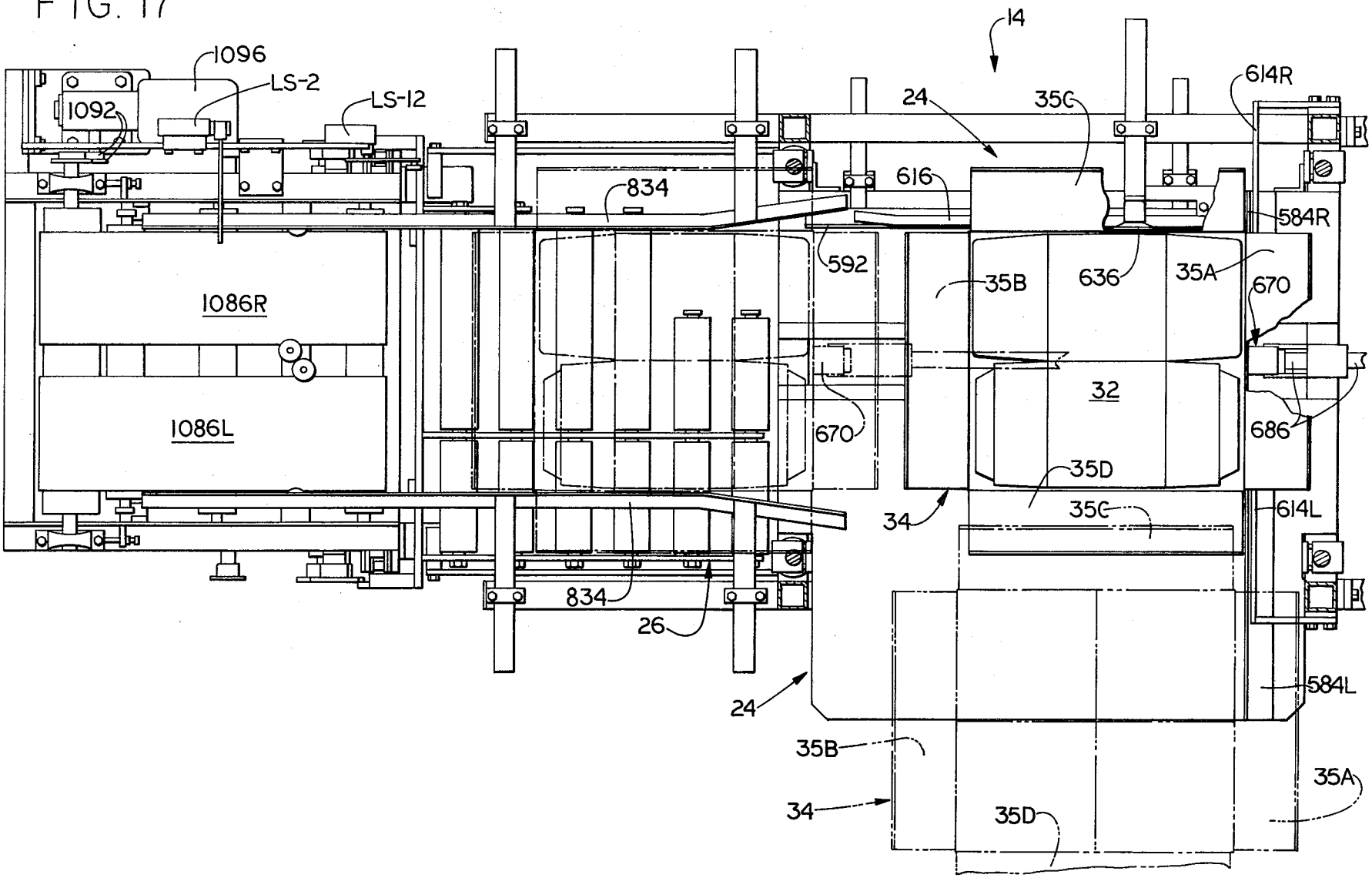
FIG. 17 is a somewhat schematic and sectional view of the machine taken along the line 17—17 in FIG. 1, showing the operation of the case handling portion of the machine.

Referring now to FIG. 17, the pusher face assembly 670 rests adjacent to the input side of the corrugated case 34. As the case discharge pusher 16 moves the ram 686 and pusher face assembly 670 in the output direction, the corrugated case 34 leaves the guidance confines of the lateral stop bar 616 of the upper case guide assembly 498 and the lateral stop 592 of the table guide assembly 496 and enters the guidance confines of a pair of output guide rails 834. As is shown more clearly in FIGS. 2 and 12, each member of the pair of output guide rails 834 is an angle iron whose input end is turned outboardly to facilitate the reception of the corrugated case 34. A pair of lateral adjustment bars 836 is rigidly affixed at their inboard ends upon the top of the horizontal flange of the guide rail 834. The vertical flange of the guide rail rises from the inboard edge of the horizontal flange of the guide rail 834 as shown. Each pair of lateral adjustment bars 836 is clampedly attached across the top surface of an output guide mount 838 by a pair of clamp plates 840. A pair of bolts 842 passes through clear holes in each clamp plate 840, passes along each side of the lateral adjustment bar 836 and threadably mount into the top surface of the output guide mount 838. In this manner, the pairs of bolts 842 can be loosened to permit lateral adjustment of the pair of output guide rails 834.

A mounting plate 839 is rigidly affixed in a vertical disposition across the input extremity of each of the output guide mounts 838. A pair of bolts 841 pass through clear holes in the overextending portions of the mounting plate 839 and threadably mount into the output surface of the output posts 40L and 40R, at an elevation approximately equal to that of the upper case guide assembly 498 (FIG. 2).

CARTON PACKING MACHINE

Case discharge assembly — frame

Figure 21:
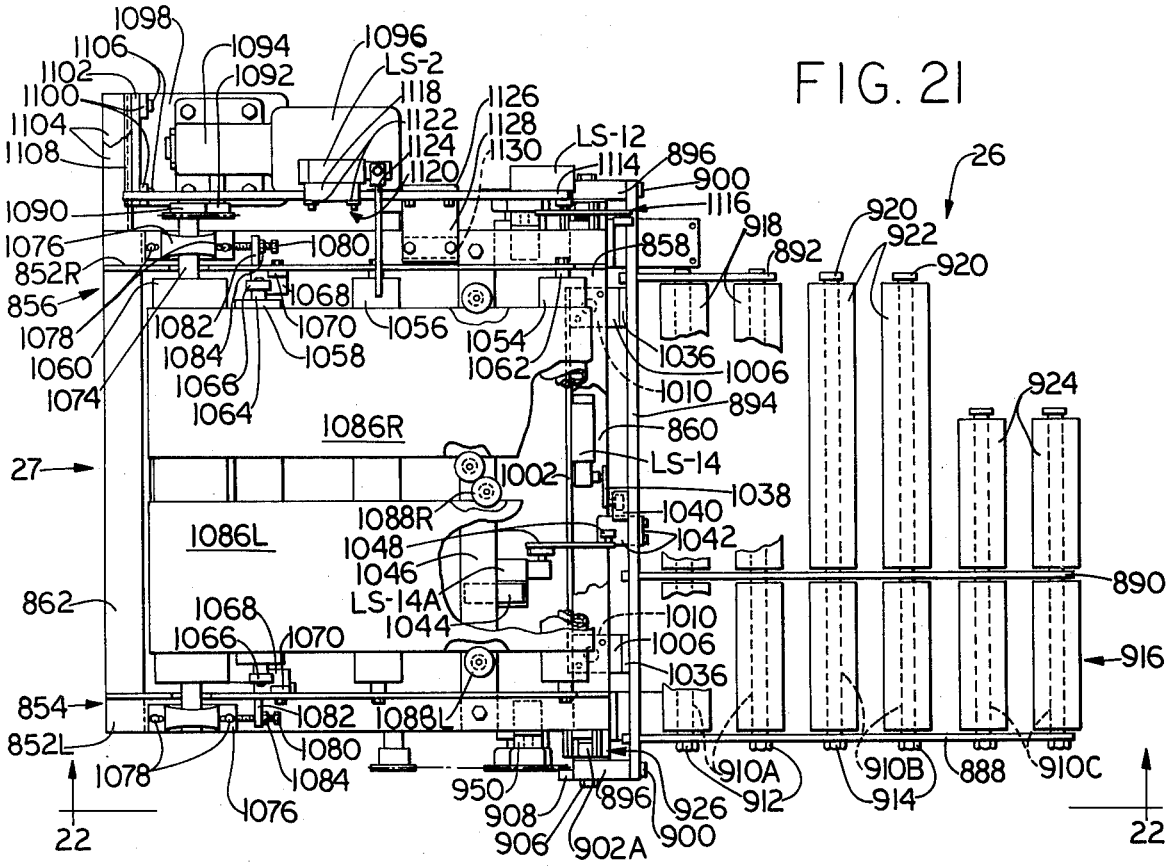
FIG. 21 is a view in section of the case discharge assembly of the machine taken on the line 21—21 in FIG. 1, parts being cut away for clarity.
Figure 22:
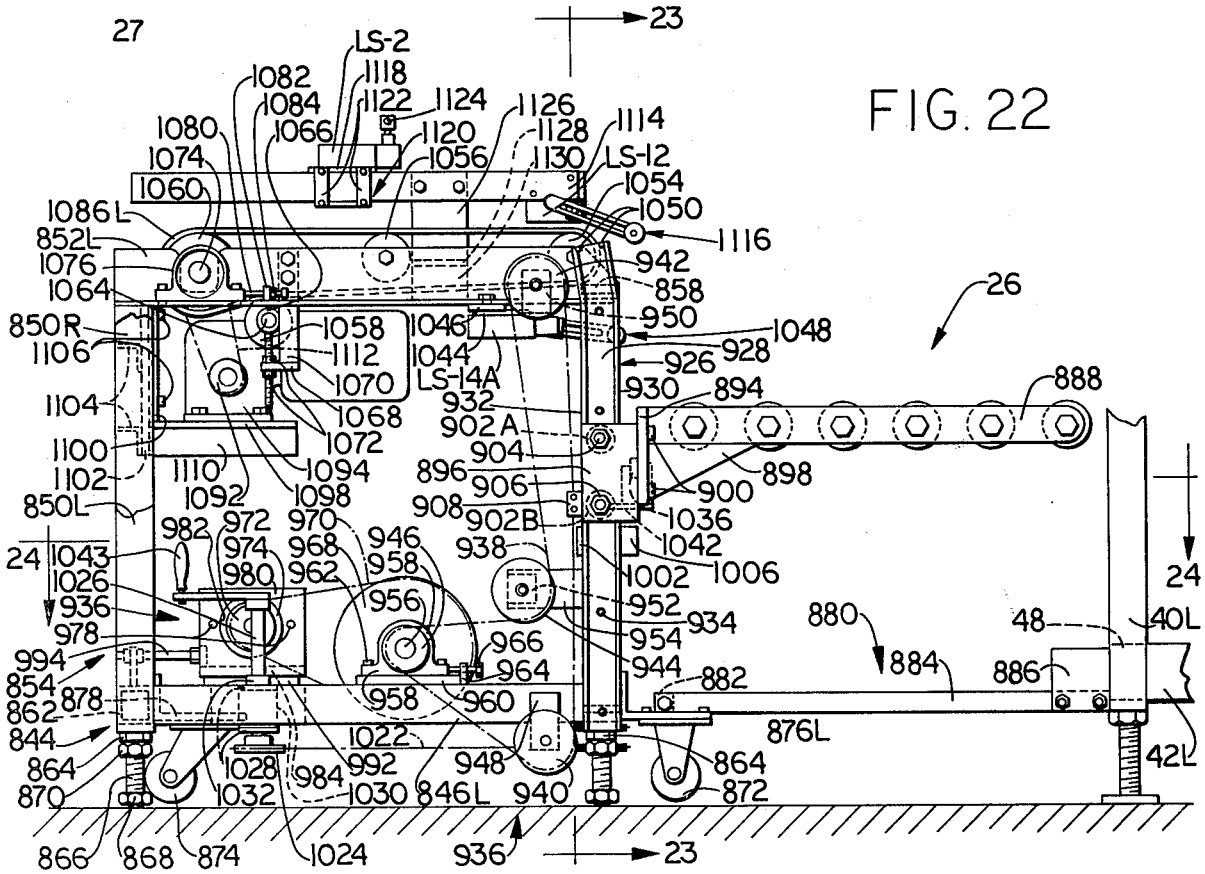
FIG. 22 is a side elevational view of the case discharge assembly looking in the direction of the arrows 22—22 in FIG. 21, including coupling means between the case discharge frame and the carton packing machine frame.
Figure 23:
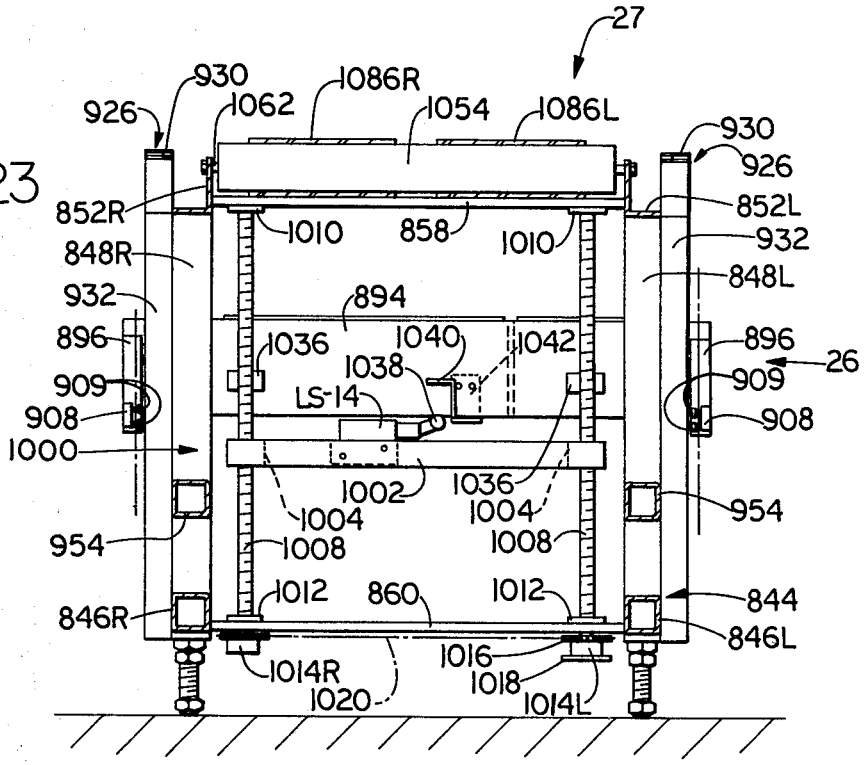
FIG. 23 is an upright sectional view taken looking on the line 23—23 in FIG. 22.
Figure 24:
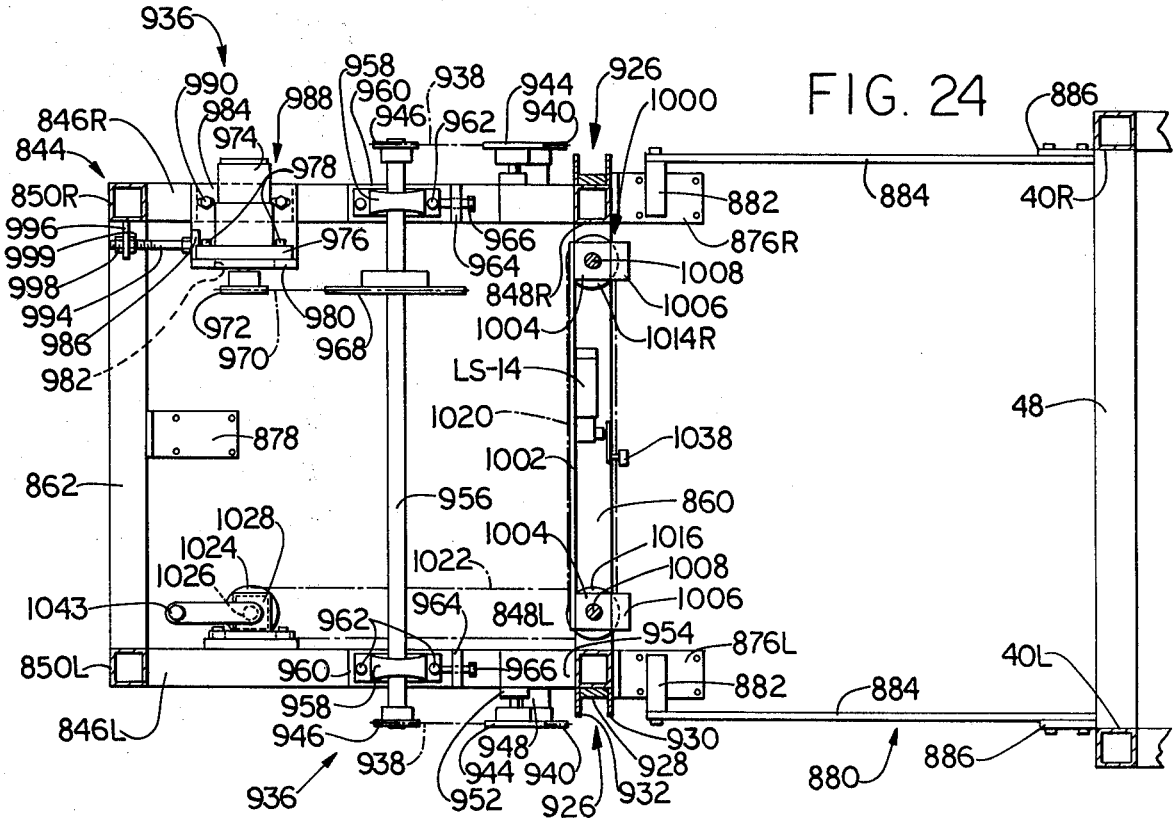
FIG. 24 is a view in section taken on the line 24—24 in FIG. 22.

The case discharge assembly 18 of the carton packing machine 10 is shown in detail in FIGS. 21–24 inclusive and is comprised of the case lift table 26 and the belt discharge assembly 27. Both these assemblies are mounted on a table frame 844 that incorporates bottom stringers 846L and 846R, input posts 848L and 848R, output posts 850L and 850R and top angle rails 852L and 852R. The bottom output surface of the left hand input post 848L is rigidly affixed to the input extremity of the left hand bottom stringer 846L. The bottom input surface of the left hand output post 850L is rigidly affixed to the output extremity of the left hand bottom stringer 846L. The left hand top angle rail 852L is rigidly affixed across the top extremities of the left hand input and output posts 848L and 850L, respectively, in such position that the vertical flange thereof is disposed along the inboard edge of its horizontal flange (FIG. 23). This combination of elements forms a left side frame subassembly 854 (FIG. 21). A right side frame subassembly 856 is formed in mirror image sameness as that of the left side frame subassembly 854. The left and right side frame subassemblies 854 and 856, respectively, are held in lateral and parallel spaced relationship by a top input lateral brace 858 (FIG. 23), a bottom input lateral brace 860, and a bottom output lateral tube 862 (FIG. 24). The top input lateral brace 858 is rigidly affixed between the inboard surfaces of, and at the input end of the vertical flanges of the top angle rails 852L and 852R. The bottom input lateral brace 860 is rigidly affixed across the lower inboard surfaces of the input posts 848L and 848R, and the bottom output lateral tube 862 is rigidly affixed across the lower inboard surfaces of the output posts 850L and 850R.

Rigidly affixed into each of the bottom extremities of the input posts 848L and 848R and the output posts 850L and 850R is a base nut 864 (FIG. 22). Threadably mounted into the base nut 864 is a threaded leg 866 that rigidly incorporates a torque nut 868 at the bottom extremity thereof. The four threaded legs 866 provide means for vertically adjusting and leveling the table frame 844. Each threaded leg 866 incorporates a lock nut 870 for fixedly holding the threaded leg 866 in set place.

The table frame 844 is made movable by a pair of fixed casters 872 (FIG. 22) and a rotatable caster 874. The pair of fixed casters 872 are fixedly attached to the bottom surface of caster angle brackets 876L and 876R (FIG. 24), that are in turn rigidly affixed to the lower input surfaces of the input posts 848L and 848R, respectively. The rotatable caster 874 is mounted on the bottom surface of a caster angle bracket 878, whose vertical flange is rigidly affixed to the input midspan surface of the bottom output lateral tube 862.

The table frame 844 is fixedly held in longitudinal sapced relationship with the frame assembly 36 of the carton packing machine 10 by a coupling assembly 880 that is shown in FIGS. 1, 22 and 24. The coupling assembly 880 includes a pair of discharge frame mounts 882, a pair of tie rods 884, and a pair of packing frame mounts 886. Each member of the pair of discharge frame mounts 882 is a bar shaped piece that is rigidly affixed laterally across the top surface of the horizontal flange of one of the caster angle brackets 876L and 876R. The output ends of the tie rods 884 are fixedly attached to the outboard ends of the discharge frame mounts 882. The input end of each of the tie rods 884 is fixedly attached to the inboard surface of, and along the bottom edge of one of the pair of packing frame mounts 886 as shown in FIGS. 22 and 24. The packing frame mounts 886 are flat plates whose input edges are rigidly affixed to the output face of the bottom output lateral beam 48, adjacent the output posts 40L and 40R of the frame assembly 36.

The case lift table 26 (FIGS. 21 and 22) incorporates a left side cantilever mount 888, a middle cantilever mount 890, a short cantilever mount 892, a lateral base plate 894, and a pair of roller mounts 896. The lower output surfaces of the left side, middle and short cantilever mounts 888, 890 and 892, respectively, each rigidly incorporate a gusset 898 for assistance in mounting thereof. The left side cantilever mount 888 is fixedly attached in a perpendicular relationship with respect to the input face of, and adjacent the left hand side of the lateral base plate 894. The middle cantilever mount 890 is similarly attached to the lateral base plate 894, but located left of center thereupon. The short cantilever mount 892 is likewise attached to the lateral base plate 844 but laterally located near the right end thereof. The pair of roller mounts 896 is fixedly attached to the outboard surface of, and at the ends of the lateral base plate 894. As can be seen in FIG. 22, the pair of roller mounts 896 are not vertically aligned with the lateral base plate 894, but fixedly attached somewhat lower thereupon by a set of four bolts 900. Rollers 902A and 902B are rotatably mounted upon shoulder shafts 904 that are in turn fixedly attached within the inboard side of the pair of roller mounts 896 by nuts 906. The roller 902A is located adjacent to the top of the roller mount 896 and the roller 902B is located adjacent the bottom edge thereof. A pair of chain lugs 908 is rigidly affixed to the output edge of the pair of roller mounts 896, located near the bottom outboard corner thereof.

Pairs of shafts 910A, 910B and 910C are fixedly mounted in the case lift table 26 as is most clearly shown in FIG. 21. The pair of shaft 910A pass through clear holes in the short and middle cantilever mounts 892 and 890, respectively, and butt against the inboard surface of the left side cantilever mount 888. A pair of bolts 912 pass through clear holes in the left side cantilever mount 888 and threadably mount into the left ends of the pair of shafts 910A. The pair of shafts 910B pass through clear holes in the middle cantilever mount 890 and butt against the inboard surface of the left side cantilever mount 888. A pair of bolts 914 pass through clear holes in the left side cantilever mount 888 and threadably mount into the left ends of the pair of shafts 910B. The pair of shafts 910C is mounted in exactly the same manner as the pair of shafts 910B. The only difference between the pairs of shaft 910B and 910C is that the latter set is shorter as shown. The shafts of the pairs of shafts 910A, 910B and 910C are equally spaced along the length of the case lift table 26.

Rotatably mounted upon the left portion of the shafts of the pairs of shafts 910A, 910B and 910C, and laterally confined by the left side and middle cantilever mounts 888 and 890, respectively, is a set of six rollers 916. Rotatably mounted upon the right hand portion of the pair of shafts 910A, and laterally confined by the short and middle cantilever mounts 892 and 890, respectively, is a pair of rollers 918. Rotatably mounted upon the right hand portion of the pair of shafts 910B and laterally confined by the middle cantilever mount 890 and a pair of lock collars 920, is a pair of rollers 922. Rotatably mounted upon the right hand portion of the pair of shafts 910C is a pair of rollers 924. The pair of rollers 924 is mounted in the same manner as the pair of rollers 922.

The rollers 902A and 902B ride vertically within the confines of a pair of roller guide rails 926, shown best in FIGS. 22, 23 and 24. Each member of the pair of roller guide rails 926 is comprised of a back plate 928, an input flange 930 and an output flange 932. The back plate 928 (FIG. 22) is a piece of bar stock whose upper end has been modified by turning a short portion thereof in the output direction. The input flange 930 is rigidly affixed along the input edge of the back plate 928 and extends outboardly therefrom. Similarly, the output flange 932 is rigidly affixed along the output edge of the back plate 928 and extends outboardly therefrom. The pair of roller guide rails 926 is fixedly attached to the outboard surfaces of the input posts 848L and 848R by a set of five bolts 934 (FIG. 22) that pass through clear countersunk holes in the back plate 928, to threadably mount in their respective input posts 848L and 848R.

The rollers 902A and 902B of the pair of roller mounts 896 fit closely within the confines of input flanges 930 and the output flanges 932 of the pair of roller guide rails 962, and resist clockwise torque loads (with respect to FIG. 22) to hold the case lift table 26 in horizontal orientation. As the case lift table 26 reaches its up position, the rollers 902A enter the modified upper portion of the pair of roller guide rails 926, moving rollers 902A in the output direction, effectively rotating the pair of roller mounts 896 counterclockwise to give the case lift table 26 an output tilt as is shown in dot-dash line at 26A in FIG. 1.

The case lift table 26 is moved up and down by a table power assembly 936 shown in FIGS. 22 and 24. The table power assembly 936 incorporates a pair of chains 938, each of which circumscribe a bottom sprocket 940, a top sprocket 942, an idler sprocket 944 and a drive sprocket 946. The ends of the pair of chains 938 are pivotally attached to the inboard sides of the pair of chain legs 908. A pair of pins 909 (FIG. 23) pass through clear holes at the ends of each chain to threadably mount into the chain lug 908. The bottom sprocket 940 is rotatably mounted from the lower outboard surface of a bottom sprocket mount 948. The two bottom sprocket mounts 948 are rigidly hung from the outboard surfaces of, and near the input ends of the bottom stringers 846L and 846R. The top sprocket 942 is rotatably mounted from the upper outboard surface of the vertical flange of a top sprocket angle mount 950. The horizontal flange of the top sprocket angle mount 950 extends inboardly from the bottom portion of the vertical flange thereof, and is rigidly affixed across the lower surface of, and adjacent the input end of the appropriate top angle rail 852L or 852R (FIGS. 21 and 22). The idler sprocket 944 is rotatably mounted from the outboard surface of a spindle block 952 (FIGS. 22 and 24) that is in turn rigidly affixed to the outboard surface of, and at the output end of an idler mount 954. The two idler mounts 954 are rigidly affixed at their input ends to the output surface of, and approximate the lower portion of the input posts 848L and 848R. The two drive sprockets 946 are fixedly mounted upon the ends of a lift table drive shaft 956.

The lift table drive shaft 956 is rotatably mounted across the bottom portion of the table frame 844 (FIGS. 22 and 24) in a pair of bearings 958. The bearings 958 in turn are fixedly attached to a pair of adjustment blocks 960. A pair of bolts 962 pass through slots in the mounting flanges of each of the pair of bearings 958 to threadably mount into one of the adjustment blocks 960. The adjustment blocks 960 are rigidly affixed upon the tops of the bottom stringers 846L and 846R. The input end of each of the pair of adjustment blocks 960 rigidly incorporates a threaded upright flange 964 through which an adjustment bolt 966 is threaded to bear against the input end of each of the pair of bearings 958. The two adjustment bolts 966, when turned clockwise, push the pair of bearings 958 in the output direction, thus bringing tension in the pair of chains 938.

The right hand portion of the lift table drive shaft 956 carries a reduction sprocket 968 (FIGS. 22 and 24). A drive chain 970 circumscribes the reduction sprocket 968 and a motor sprocket 972 that is in turn attached to the shaft of a hydraulic motor 974. The hydraulic motor 974 integrally incorporates a mounting flange 976 (FIG. 24). A pair of bolts 978 pass through clear holes in each side of the mounting flange 976 to threadably mount into a vertical mount plate 980. The vertical mount plate 980 incorporates a large central hole 982 that accommodates the mounting end of the motor 974 and permits clear passage of its shaft. The bottom edge of the vertical mount flange 980 is rigidly affixed to the inboard edge of a mount plate 984. The mount plate 984 rigidly incorporates at its left hand output corner an adjustment lug 986, and a pair of slots 988 located parallel to the right hand edge thereof. A pair of bolts 990 (FIG. 24) passes downwardly through the pair of slots 988 to threadably mount into the top surface of a motor mount 992 that is in turn rigidly affixed to the top surface of the right hand bottom stringer 846R. A threaded rod 994 is threadably mounted into the output face of the adjustment lug 986, and secured therein by a lock nut. The output end of the threaded rod extends through a clear hole in a tension plate 996, that is in turn rigidly affixed to the bottom output lateral tube 862 and the right hand output post 850R. A tension nut 998 draws the threaded rod 994 and consequently the motor 974 in the output direction, pulling tension in the drive chain 970. The tension nut 998 is held in fixed place by a lock nut 999 that is turned against the input surface of the tension plate 996. The mount plate 984 is secured in place by tightening the pair of bolts 990.

The case lift table 26 is limited in downward travel by a down stop assembly 1000 and a limit switch LS-14 as is shown in FIGS. 23 and 24. The downstop assembly 1000 incorporates a lateral brace 1002 that rigidly incorporates upon the input surface of, and at each end thereof, a threaded block 1004. A down stop 1006 is fixedly attached to the input surface of each threaded block 1004 as is shown in FIGS. 21, 22 and 24. The threaded blocks 1004 are mounted upon a pair of threaded rods 1008. The threaded rods 1008 integrally incorporate at each end thereof a short length of smaller diameter clear shaft for mounting thereof in a pair of top bushings 1010 and a pair of bottom bushings 1012 (FIG. 23). The top bushings 1010 are fixedly attached to the underside of the top input lateral brace 858, and the bottom bushings 1012 are fixedly attached to the top surface of the bottom input lateral brace 860. The clear shaft extensions of the bottom ends of the pair of threaded rods 1008 pass through clear holes in the bottom input lateral brace 860 to fixedly incorporate sprockets 1014L and 1014R (FIG. 23). The sprocket 1014R is a single wheel with its hub mounted downward. The sprocket 1014L incorporates an upper wheel 1016 and a lower wheel 1018. A lateral chain 10120 circumscribes the wheel 1016 and the sprocket 1014R, thus coordinating the rotation of the pair of threaded rods 1008.

A longitudinal chain 1022 (FIGS. 22 and 24) circumscribes the wheel 1018 of the sprocket 1014L, and a crank sprocket 1024, that is in turn fixedly attached to the lower end of a crank shaft 1026. The crank shaft 1026 is rotatably mounted in a pair of bushing plates 1028. The plates of the pair of bushing plates 1028 are rigidly affixed as caps to each end of a square mount tube 1030 (FIG. 22). The mount tube 1030 is rigidly affixed to the inboard surface of the bottom stringer 846L. The crank shaft 1026 is retained in the pair of bushing plates 1028 by a set collar 1032. A crank arm and handle 1043 is fixedly attached to the upper end of the crank shaft 1026 for manual rotation thereof. Therefore, as the crank arm and handle 1043 is turned, the threaded blocks 1004 and the down stops 1006 can be raised or lowered as desired. A pair of stop blocks 1036 is fixedly attached to the output surface of the lateral base plate 894 of the case lift table assembly 26 (FIGS. 21 and 23), and is laterally located to be in vertical alignment with the two down stops 1006.

The limit switch LS-14 is fixedly attached to the input side of, and at the mid-span of the lateral brace 1002. A switch arm and roller 1038 is pivotally mounted within the head of the limit switch LS-14 and is so disposed that the roller thereof comes in working relationship with a switch trip 1040 as is shown in FIGS. 21 and 23. The switch trip 1040 is a segment of angle iron, the horizontal portion thereof functioning as the working element in cooperation with the switch arm and roller 1038, while the lower extremity of its vertical portion is rigidly attached to a trip mount 1042. The trip mount 1042 is again a piece of angle iron, whose vertical portion is fixedly attached to the input surface of the lateral base plate 894, and whose horizontal portion extends in the output direction from the lower extremity of the vertical portion, to rigidly accommodate upon the right edge thereof, the switch trip 1040. As the case lift table 26 descends, the switch trip 1040 actuates the limit switch LS-14 which activates circuitry described hereinafter to stop downward advance of the motor 974 just before the pair of stop blocks 1036 comes into physical contact with the two down stops 1006, thus bringing the case lift table 26 to a positive and pre-positioned halt.

A limit switch LS-14A (FIGS. 21 and 22) is fixedly attached to the undersurface of a switch mount plate 1044 that is in turn rigidly affixed to the bottom surface of a lateral guide bar 1046. The lateral guide bar 1046 is rigidly affixed to the bottom surfaces of and near the input ends of, the horizontal flanges of the top angle rails 852L and 852R. A switch arm and roller 1048 is pivotally mounted in the head of the limit switch LS-14A, the head of the limit switch protruding in the input direction therefrom, such that the switch arm and roller 1048 comes into working relationship with the horizontal portion of the trip mount 1042. As the case lift table 26 rises, the trip mount 1042 rotates the switch arm and roller 1048 counterclockwise (FIG. 22), actuating the limit switch LS-14A that actuates the appropriate circuits to stop upward advance of the motor 974. The motor 974 is stopped just before the rollers impact a pair of stops 1050. The stops 1050 are rigidly affixed to the top inner surfaces of the flanges of each member of the pair of roller guide rails 926. This brings the case lift table 26 to a positive and pre-positioned halt in the up position.

The belt discharge assembly 27 is shown in FIGS. 21 and 22, and incorporates an input roller 1054, a middle roller 1056, an idler roller 1058, and a drive roller 1060. The input roller 1054 is rotatably mounted upon an input shaft 1062 that is in turn fixedly attached between the vertical flanges of, and at the input ends of the top angle rails 852L and 852R (FIG. 23). The middle roller 1056 is mounted in the same way as the input roller 1054 but at the center of the span of the top angle rails 852L and 852R. The idler roller 1058 is rotatably mounted upon an idler shaft 1064, that is in turn fixedly held at each end within the eye of an eyebolt 1066. The threaded shaft of each eyebolt 1066 extends downwardly through a clear hole in an idler mount plate 1068, each mount plate 1068 being rigidly affixed to the lower extremity of an idler hanger 1070. The idler hangers 1070 are attached to the top angle rails 852L and 852R. The threaded shafts of the eyebolts 1066 are fixedly set and clampedly held within the idler mount plates 1068 by a pair of set nuts 1072.

The drive roller 1060 is fixedly attached to a drive shaft 1074 that is in turn rotatably mounted in a pair of bearings 1076. Each of the bearings 1076 is fixedly attached to the top surface of the horizontal flange of its respective top angle rail 852L and 852R by a pair of bolts 1078. The bolts 1078 pass vertically downward through clear slots in the mounting flanges of the bearing 1076 to threadably mount into the top angle rails 852L or 852R. A pair of adjusting bolts 1080 threadably pass through a pair of adjusting mounts 1082 to bear against the input ends of the pair of bearings 1076. The adjusting mounts 1082 are rigidly affixed to the horizontal and vertical flanges of the top angle rails 852L and 852R. The adjusting bolts are held in fixed place by pairs of lock nuts 1084.

Belts 1086L and 1086R circumscribe the input and drive rollers 1054 and 1060 respectively, while the middle roller 1056 provides mid-span support and the idler roller 1058 provides tension therein. The belt 1086L is held in lateral place upon the rollers by side guide rollers 1088L and 1088R, that are in turn rotatably mounted in a horizontal disposition from the top surface of the lateral guide bar 1046 (FIG. 21) to work against the edges of the lower span of the belt 1086L. The belt 1086R is held in lateral place upon the input and drive rollers 1054 and 1060 respectively, in the same manner as the belt 1086L.

The right end of the drive shaft 1074 fixedly incorporates a drive sprocket 1090. In alignment with the drive sprocket 1090 is a motor sprocket 1092, that is in turn fixedly attached to the output shaft of a reduction gear box 1094. Power is supplied to the reduction gear box 1094 by a motor 1096 that is fixedly attached to the input end thereof. The reduction gear box 1094 is fixedly attached upon the top of a mount plate 1098 that is in turn rigidly affixed to the bottom extremities of a pair of vertical mount bars 1100. The vertical mount bars 1100 are fixedly and adjustably mounted to a motor mount 1102 that is in turn rigidly affixed to the input surfaces of a pair of mount angles 1104 whose left extremities are rigidly affixed to the right hand surface of the output post 850R. A set of four bolts 1106 pass through clear holes in the pair of vertical mount bars 1100, pass through vertical slots in the motor mount 1102, and threadably mount into a pair of horizontal clamp bars 1108 as is indicated in FIG. 21. A stiffener 1110 is rigidly affixed in a longitudinal disposition along the centerline of the bottom surface of the mount plate 1098. The output extremity of the stiffener 1110 bears against the lower input surface of the motor mount 1102, thus resisting vertical loads applied upon the top of the mount plate 1098. A belt drive chain 1112 circumscribes the motor sprocket 1092 and the drive sprocket 1090 to complete the power transfer system from the motor 1096 to the belts 1086L and 1086R of the belt discharge assembly 27.

The belt discharge assembly 27 is controlled by limit switches LS-12 and LS-2. The limit switch LS-12 is fixedly attached to the outboard surface of, and at the input end of a longitudinally disposed switch slide bar 1114. An adjustable switch arm and roller 1116 is pivotally mounted within the head of the limit switch LS-12, the head being disposed upon the inboard surface of, and at the input end thereof. The roller of the adjustable switch arm and roller 1116 comes in working relationship with the top edge of the lateral base plate 894 of the case lift table 26 as it comes to its full up position. Counterclockwise rotation (FIG. 22) of the adjustable switch arm and roller 1116 causes the motor 1096 to run, the clockwise rotation thereof causes the motor 1096 to stop when the case lift table 26 descends.

The limit switch LS-2 is fixedly attached to the right side of a slide block 1118, the left side of which is so shaped as to encompass the top, right side and bottom of the switch slide bar 1114. A set of four bolts 1120 pass through clear holes in a pair of clamp bars 1122, pass above and below the switch slide bar 1114, and threadably mount into the four corners of the slide block 1118 to clampedly hold the limit switch LS-2 thereto. The head of the limit switch LS-2 is disposed upon the input end of the limit switch LS-2, and a switch rod 1124 is pivotally mounted therein so that it extends horizontally toward the center of the machine. Clockwise rotation (FIG. 21) of the switch rod 1124 makes the appropriate circuitry to indicate that a departing corrugated case is in sufficient position upon the belts 1086L and 1086R to permit the case lift table 26 to be returned to its down position.

The switch slide bar 1114 is fixedly attached across the top inboard surface of a vertical slide bar mount 1126, that is in turn rigidly affixed along its bottom inboard edge to the outboard end of a horizontal bar mount 1128. The inboard end of the horizontal bar mount 1128 is fixedly attached upon the top of a riser mount block 1130 that is in turn rigidly affixed upon the top surface of, and at the mid-span of, the horizontal flange of the top angle rail 852R.

CORRUGATED CASE DISCHARGE OPERATION

Referring to FIGS. 1 and 17, the limit switch LS-6 (FIG. 3) of the packing assembly 14, closes and makes the appropriate circuitry that commands the case discharge pusher 16 to advance. As previously described, the elevator assembly 20 is at its up position, physically clearing the way for the case discharge pusher 16. The pusher face assembly 670 and the ram 686 move in the output direction until the limit switch LS-5 (FIG. 18) is actuated, which will stop the pusher face assembly 670 at the lateral plane of the output post 40L and 40R as is shown in dot-dash line in FIG. 17. The figure also shows that the corrugated case 34 is now under the lateral control of the pair of output guide rails 834. The filled corrugated case 34, having been moved from the solid line position shown in FIGS. 1 and 17, to the full stroke position determined by LS-5, will now coast to the double-dot-dash line position shown in FIG. 1, coming to rest against the input edge of the top input lateral brace 858 of the table frame 844 of the case discharge assembly 18. The limit switch LS-5 also makes the proper circuitry that causes the hydraulic motor 974 to run in counterclockwise rotation (FIGS. 1 and 22), raising the case lift table 26 to the dot-dash line position shown in FIG. 1. As the case lift table 26 reaches this up and tilted position, the limit switch LS-14A is opened, which stops the hydraulic motor 974, and the limit switch LS-12 is closed which starts the electric motor 1096 (FIG. 22). The motor 1096 turns the motor sprocket 1092 counterclockwise, which runs the belts 1086L and 1086R in counterclockwise rotation. As soon as the case lift table 26 is up and tilted, gravity will move the corrugated case 34 off the case lift table 26 and onto the running belts 1086L and 1086R. The corrugated case 34 moves in the output direction to the position indicated in triple dot-dash line in FIG. 1 where the case closes the limit switch LS-2. The limit switch LS-2 (FIG. 22) makes the appropriate circuitry that starts the hydraulic motor 974, which now rotates in the clockwise direction to move the case lift table 26 down. As the case lift table 26 leaves its up position, the limit switch LS-12 is released, which stops the electric motor 1096 and the belts 1086L and 1086R, and the case remains in the triple dot-dash line position for a sufficient time for inspection by the operator. When the case lift table 26 reaches its down position, the limit switch LS-14 (FIG. 21) is actuated, which stops the hydraulic motor 974 and restarts the motor 1096 and the belts 1086L and 1086R to deliver the case to a customer conveyor 1132 (FIG. 1). The case lift table 26 waits in this position for the case discharge pusher 16 to recycle. Referring again to FIG. 19, the limit switch LS-5 makes the appropriate circuitry which retracts the case discharge pusher 16. As it reaches its full back position, the limit switch LS-3 is closed to make the appropriate circuitry to indicate that the pusher is back and permit the elevator assembly 20 to pass the limit switch LS-16 to continue the next cycle uninterrupted. This assumes that the operator has correctly inserted another corrugated case 34 and depressed the vacuum pushbutton SW-10 to re-establish vacuum to the cups 636 and 604.

OPERATION

The operation of the machine will now be described with particular reference to FIG. 25, which shows electrical connections of the machine, and FIG. 26, which shows hydraulic connections.

Figure 25:
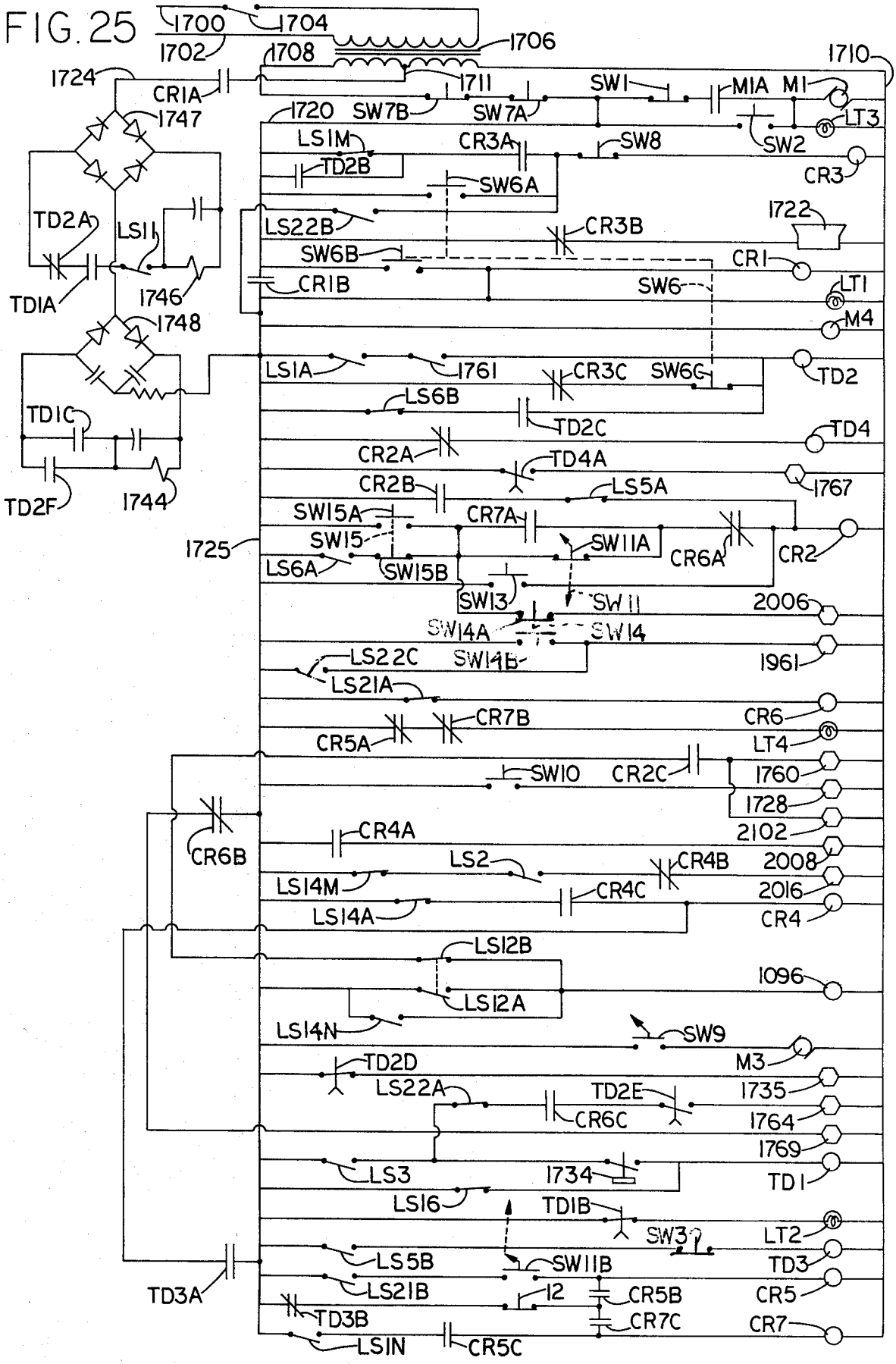
FIG. 25 is a schematic view showing electrical components of the machine.
Figure 26:
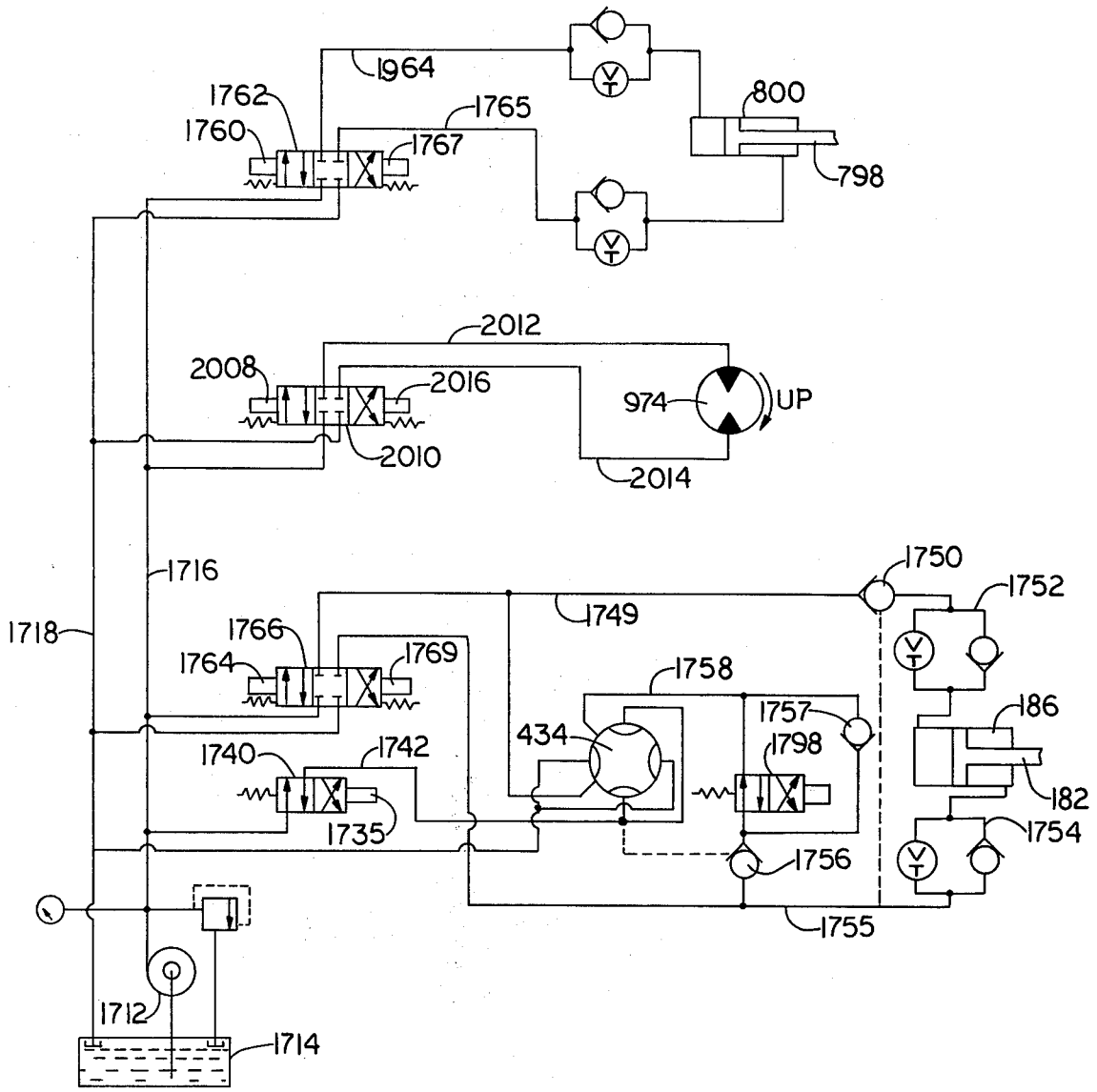
FIG. 26 is a schematic view of hydraulic components of the machine.

Referring to FIG. 25, electrical power is supplied by line leads 1700 and 1702 through a line switch 1704 to a primary winding of a transformer 1706. The secondary winding of the transformer 1706 provides power across leads 1708 and 1710. A portion of the secondary winding of the transformer 1706 supplies power across the lead 1708 and a lead 1711. A hydraulic pump motor M-1 is energized when a push button switch SW-2 is closed. Motor relay contacts M-1A are closed when the motor M-1 is energized. A lamp LT-3 is illuminated when the motor M-1 is energized. The hydraulic pump motor M-1 can be stopped when a pushbutton switch SW-1 is opened. The hydraulic pump motor M-1 drives a pump 1712 (FIG. 26) to supply hydraulic fluid under pressure from a tank 1714 to a pressure line 1716. Hydraulic fluid is returned to the tank 1714 through a return line 1718. A lead 1720 (FIG. 25) is normally connected to the lead 1708 through contacts of emergency stop switches SW-7A and SW-7B.

A switch SW-11 can be disposed in the position shown with contacts SW-11A closed and contacts SW-11B open if a single stack is to be deposited in a case. If two stack portions are to be deposited in a single case, the switch SW-11 is placed in its other position.

A control start push button switch SW-6 is actuated to close contacts SW-6A and SW-6B, to open contacts SW-6C. Closing of the contacts SW-6A energizes a control relay CR-3 to close hold-in contacts CR-3A and open contacts CR-3B and CR-3C thereof. The contacts CR-3B actuate an alarm 1722 when the control relay CR-3 is de-energized. Closing of the contacts SW-6B energizes a control relay CR-1 to close contacts CR-1A and CR-1B thereof. Closing of the contacts CR-1A connects a lead 1724 to the lead 1711. A lamp LT-1 is energized when the control relay CR-1 is energized. Closing of the contacts CR-1B connects a lead 1725 to the lead 1720 and serves to energize a vacuum pump motor M-4. The motor M-4 drives a vacuum pump 1726 (FIG. 27) to impress a vacuum on a line 1727.

An on-off switch SW-9 is placed in its other position to energize the conveyor drive motor M-3 (FIGS. 1 and 14).

A push button reject switch SW-8 (FIG. 25) is opened to deenergize the control relay CR-3. Deenergizing of the control relay CR-3 causes closing of the contacts CR-3C to energize a time delay relay TD-2 to open contacts TD-2A, close contacts TD-2B and TD-2C, open delay contacts TD-2D, close delay contacts TD-2E, and open contacts TD-2F. Closing of the contacts TD-2E energizes a solenoid 1764 to advance a valve 1766 to the right as shown in FIG. 26 to connect a line 1749 to the pressure line 1716 so that fluid flows to the hydraulic cylinder 186 to cause downward advance of the elevator assembly 20 (FIGS. 1 and 3), the fluid returning through a line 1755. The elevator assembly 20 advances until the limit switch LS-22 (FIG. 3) is actuated when the elevator assembly 20 reaches its lowermost position. When the limit switch LS-22 is actuated, contacts LS-22A open to deenergize the solenoid 1764, contacts LS-22B close to energize the control relay CR-3 and contacts LS-22C close to energize a flap closing solenoid 1961. Energizing the control relay CR-3 opens contacts CR-3C to deenergize the time delay relay TD-2. As will be explained more fully hereinafter, the basket bottom is then opened, and the elevator assembly 20 returns to its raised position.

A push button SW-12 is opened to deenergize control relays CR-5 and CR-7 to close contacts CR-5A and CR-7B and open contacts CR-5B, CR-5C, CR-7A and CR-7C. A push button reset switch SW-3 is actuated to open the contacts thereof. Opening of the contacts of the switch SW-3 (FIG. 25) denergizes a relay TD-3 to open contacts TD-3A and close contacts TD-3B.

The time delay relay TD-2 is in deenergized position with contacts TD-2A closed, contacts TD-2B and TD-2C open, time delay contacts TD-2D closed, time delay contacts TD-2E open, and contacts TD-2F open. Closing of the time delay contacts TD-2D energizes a solenoid 1735 which advances a valve 1740 (FIG. 26) to its other position to direct fluid under pressure along a line 1742 to the rate valve 434.

The operator places the case in position engaging the vacuum cups 604 and 636, and a switch SW-10 is closed to energize a solenoid 1728. The solenoid 1728 advances a valve 1730 (FIG. 27) to its other position to impress a vacuum on a line 1732 and on the vacuum cups 604 and 636. When the case 34 engages the vacuum cups, a vacuum switch 1734 is actuated.

The case discharge pusher 16 is in retracted position, the limit switch LS-3 (FIGS. 18 and 25) is closed and the vacuum switch 1734 energizes a time delay relay TD-1 to close contacts TD-1A, to open time delay contacts TD-1B, and to open contacts TD-1C. Opening of contacts TD-1B deenergizes a lamp LT-2. Opening of contacts TD-1C deenergizes a brake solenoid 1744, and closing of the contacts TD-1A energizes a clutch solenoid 1746. The clutch solenoid 1746 actuates the clutch 654 (FIG. 14) to drive the drive chain 662 to drive a main conveyor 1499 (FIG. 1), only a part of which is shown, which delivers cartons to the conveyor belt 87. A limit switch LS-11 (FIG. 23) not shown in detail, is closed when cartons are available for delivery by the main conveyor 1499. Deenergizing of the brake solenoid 1744 releases the brake 666 (FIG. 1). The conveyor belt 87 advances the cartons to the nip roll assembly 30 (FIG. 5) which drives the cartons beneath the sensing rod 414.

Direct current for the clutch solenoid 1746 (FIG. 25) and the brake solenoid 1744 are supplied by rectifier networks 1747 and 1748, respectively. As the stack builds up under the sensing rod 414, the rate valve 434 is caused to swing clockwise to connect the line 1742 through the line 1749, a pilot check valve 1750 and a throttle check valve unit 1752 to the hydraulic cylinder 186 (FIGS. 5 and 24) to cause extension of the cylinder rod 182 thereof. Fluid returns from the cylinder 186 through a throttle check valve unit 1754, the line 1755, a pilot check valve 1756 and a check valve 1757, and a line 1758 to the rate valve 434 to be directed by the rate valve 434 to the return line 1718. The pilot check valve 1756 is controlled by pressure in the line 1742 and permits flow therethrough when there is pressure in the line 1742. The rate valve 434 controls the advance of the elevator assembly 20 (FIG. 1) so that the level of the top of the stack 32 (FIG. 5) remains substantially constant as the stack builds up. If the stack moves downwardly too far, the rate valve 434 (FIG. 26) swings counterclockwise so that fluid is directed through the line 1758, a solenoid operated valve 1798, the pilot check valve 1756, the line 1755 to the hydraulic cylinder 186 to cause retraction of the cylinder rod 182. Fluid returns from the cylinder 186 through the pilot check valve 1750, the line 1749 and the rate valve 434 to the return line 1718. The pilot check valve 1750 permits flow when there is pressure in the line 1755. When the stack has reached a predetermined height, the contacts of the limit switch LS-16 open. If the contacts of the limit switch LS-3 (FIG. 18) are closed to indicate the case discharge pusher 16 is retracted, the opening of the contacts of the limit switch LS-16 has no effect.

When the height of the stack is a little less than that for a full count, the limit switch LS-1A is actuated. Thereafter, when a full count has been reached by a counting mechanism (not shown in detail) and a predetermined number of cartons has been delivered to the belt conveyor 87, a count switch 1761 closes to energize the time delay relay TD-2 to initiate a cycle of rapid descent of the elevator assembly 20 with the completed stack. Opening of the contacts TD-2A deenergizes the clutch solenoid 1746 and closing of the contacts TD-2F energizes the brake solenoid 1744 to actuate the brake 666 (FIG. 1) to stop the delivery of cartons to the belt conveyor 87. The belt conveyor 87 continues to run to deliver cartons that are thereon to the stack. Closing of the contacts TD-2B provides a circuit which bypasses contacts LS-1M of the limit switch LS-1 so that, as the contacts LS-1M of the limit switch LS-1 open as the stack is lowered further, there is no effect on the control relay CR-3. After a time delay, the contacts TD-2D open to deenergize the solenoid 1735 to permit the valve 1740 to return to the position shown in FIG. 26 so that pressure is no longer applied to the rate valve 434. After a time delay, the contacts TD-2E close to energize the solenoid 1764 to advance the valve 1766 to the right as shown in FIG. 26 to connect the line 1749 to the pressure line 1716 to cause continuous advance of the elevator and the stack downwardly. The time delay is sufficient to permit the cartons on the belt conveyor 87 to reach the stack.

Figure 28:
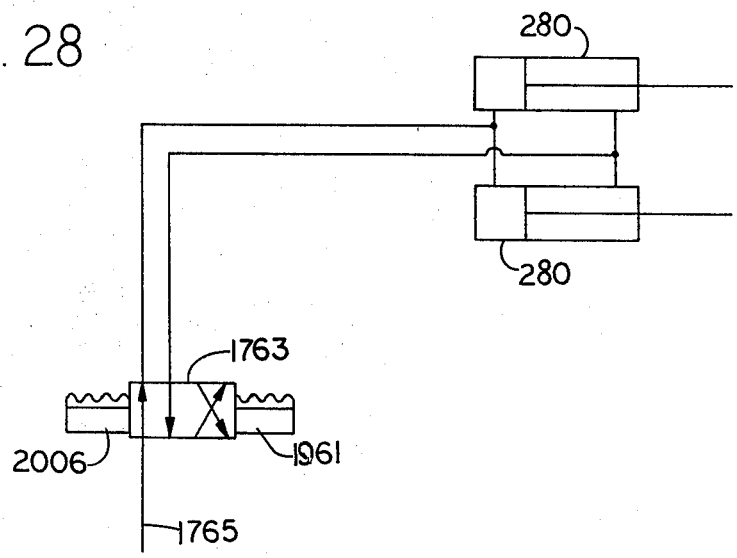
FIG. 28 is a schematic view of pneumatic connections of the machine.

When the elevator assembly 20 reaches its lowered position, the limit switch LS-22 (FIG. 3) is actuated. Closing of the contacts LS-22C of the limit switch LS-22 energizes a solenoid 1961. The solenoid 1961 advances an air valve 1763 to its other position of FIG. 28 to direct air under pressure from an appropriate source of air under pressure 1765 to the cylinders 280 to cause opening of the basket floor 152 to permit the stack of cartons 37 to fall into the case 32. When the basket floor 152 is fully open, the limit switch LS-21 (FIG. 10) is actuated to open contacts LS-21A and close contacts LS-21B. Opening of the contacts LS-21A deenergizes a relay CR-6 to close contacts CR-6A and CR-6B and open contacts CR-6C. Closing of the contacts LS-21B has no effect when the switch SW-11 is in the position shown. Closing of the contacts CR-6B energizes a solenoid 1769 which advances the valve 1766 to the left as shown in FIG. 26 to cause retraction of the cylinder rod 182 by the cylinder 186 to raise the elevator assembly 20. When the elevator assembly 20 is fully raised, the limit switch LS-6 (FIG. 3) is actuated to close contacts LS-6A and open contacts LS-6B. Opening of the contacts LS-6B deenergizes the time delay relay TD-2 to start carton flow to a new stack. Closing of the contacts LS-6A energizes a solenoid 2006 and a control relay CR-2. Energizing of the control relay CR-2 opens contacts CR-2A to deenergize a time delay relay TD-4, closes hold-in contacts CR-2B and closes contacts CR-2C. Deenergizing of the time delay relay TD-4 opens contacts TD-4A thereof.

Closing of the contacts CR-2C energizes a solenoid 1760 and a solenoid 2102 when the limit switch LS-14 (FIG. 25) is actuated to open contacts 14-M and close contacts 14-N to indicate the lift table 26 is in lowered case receiving position. Energizing of the solenoid 2102 advances the valve 1730 (FIG. 27) to the position shown to cut off the vacuum at the vacuum cup assemblies 604 and 636. The solenoid 1760 (FIG. 26) advances a valve 1762 to the right as shown in FIG. 24 to direct fluid under pressure along a line 1964 to the pusher cylinder 800 (FIG. 18) to advance the case onto the lift table 26 (FIG. 22), the fluid returning through a line 1765 to the return line 1718. When the pusher is fully advanced, the limit switch LS-5 is actuated to open contacts LS-5A and to close contacts LS-5B. Opening of the contacts LS-5A deenergizes the control relay CR-2 to permit closing of the contacts CR-2A to energize the time delay relay TD-4 and cause closing of the contacts TD-4A thereof after a time delay to energize a solenoid 1767 which advances the valve 1762 to the left to direct the fluid under pressure along the line 1765 to cause retraction of the piston rod 798 of the cylinder 800 and cause retraction of the case discharge pusher 16. Closing of the contacts LS-5B energizes the relay TD-3. Energizing of the solenoid 2102 advances the valve 1730 (FIG. 27) to the position shown to remove vacuum from the vacuum cups 604 and 636. Energizing of the solenoid 2006 advances the valve 1763 (FIG. 28) to its other position to direct air under pressure to the cylinders 280 to cause closing of the basket bottom 152 (FIG. 10). Energizing of the relay TD-3 causes closing of the contacts TD-3A to energize a relay CR-4 to close contacts CR-4A, open contacts CR-4B, and close hold-in contacts CR-4C.

Closing of the contacts CR-4A energizes a solenoid 2008. The solenoid 2008 advances a valve 2010 (FIG. 26) to the right to direct fluid under pressure through a line 2012 to the hydraulic motor 974 (FIG. 22) to cause raising of the lift table 26, the fluid returning through a line 2014 and the valve 2010 to the return line 1718.

As the lift table 26 approaches its uppermost position, the limit switch LS-14A (FIG. 22) is actuated to deenergize the control relay CR-4 to open the contacts CR-4A deenergizing the solenoid 2008 to permit the valve 2010 to return to its central position at which fluid is no longer supplied to the hydraulic motor 974. The lift table 26 (FIG. 22) advances to its uppermost position at which the limit switch LS-12 is actuated to close contacts LS-12A and open contacts LS-12B. Closing of the contacts LS-12A energizes the motor 1096 to advance the running belts 1086R and 1086L (FIG. 23) to withdraw the case from the lift table 26. As the case advances onto the running belts 1086R and 1086L, the case engages the actuator of the limit switch LS-2 to actuate the limit switch LS-2 closing the contacts thereof to energize a solenoid 2016 to advance the valve 2010 to the left to direct fluid under pressure along the line 2014 to the hydraulic motor 974 causing lowering of the lift table 26. When the lift table 26 is fully lowered, the limit switch LS-14 is actuated to open contacts LS-14M thereof to deenergize the solenoid 2016 to permit the valve 2010 to return to its center position at which the motor 974 is stopped. While the lift table is descending, the motor 1096 is deenergized so that the case remains in position on the belts 1086L and 1086R for a sufficient time for the operator to inspect the case. When the lift table is fully lowered and the limit switch LS-14 is actuated to close contacts 14-N, the motor 1096 advances to advance the case to the customer conveyor 1132.

If two stack portions are to be deposited in a single case 34, the switch SW-11 is disposed in its other position at which contacts SW-11B are closed. The switch SW-12 is momentarily opened to insure release of hold-in circuits to be described hereinafter. When a first stack portion has been formed, the limit switch LS-1 is actuated to open the contacts LS-1M and to close contacts LS-1N thereof. Opening of the contacts LS-1M deenergizes the control relay CR-3. Deenergizing of the control relay CR-3 causes contacts CR-3C thereof to close to energize the relay TD-2 stopping delivery of cartons to the conveyor belt 87 and causing descent of the elevator to its lowered position. When the elevator assembly is at its lowered position, the basket floor 152 (FIG. 10) opens as already described. In addition, when the elevator assembly is at its lowered position, closing of contacts LS-22B of the limit switch LS-22 energizes the control relay CR-3. When the basket floor 152 opens, the limit switch LS-21 is actuated closing the contacts LS-21B to energize a control relay CR-5 to open contacts CR-5A and close contacts CR-5B and CR-5C. Opening of the contacts CR-5A deenergizes a lamp LT-4, which is illuminated when the case is ready for the first stack. The contacts CR-5B serve as hold-in contacts for the control relay CR-5. When the basket floor 152 opens, the contacts LS-21A open to deenergize the control relay CR-6 to cause closing of the contacts CR-6B energizing the solenoid 1769 to cause continuous upward advance of the elevator as already explained. When the elevator is fully raised, the limit switch LS-6 is actuated to open the contacts LS-6B deenergizing the relay TD-2 to cause advance of cartons to the belt conveyor 87 as explained before. However, the case discharge pusher 16 is not advanced at this time. When a second stack portion has been accumulated and the count switch 1761 indicates a proper count and the limit switch LS-1A is closed, the relay TD-2 is again energized to stop advance of cartons to the conveyor belt 87 and to initiate descent of the elevator as described hereinabove. When the limit switch LS-1 is actuated to close the contacts LS-1N thereof as the elevator descends, the control relay CR-7 is energized to close contacts CR-7A, open contacts CR-7B and close contacts CR-7C. When the elevator assembly 20 is fully lowered and the basket floor 152 is opened to actuate the limit switch LS-21 and deenergize the control relay CR-6 causing raising of the elevator as already described. When the elevator is fully raised, the limit switch contacts LS-6A close to energize the control relay CR-2, to close the contacts CR-2C and cause energizing of the solenoid 1760 and advance of the case discharge pusher 16, as already described. When the case discharge pusher 16 is fully advanced, the limit switch LS-5 is actuated closing contacts LS-5B to energize the delay relay TD-3 to open the contacts TD-3B thereof deenergizing the control relays CR-5 and CR-7 to permit the next cycle of the machine.

If it is necessary to open the basket bottom 152, as to release cartons therein at the start of machine operation, a switch SW-14 is momentarily actuated to open contacts SW-14A and close contacts SW-14B to cause opening of the basket bottom 152. When a switch SW-15 is actuated to close contacts SW-15A and open contacts SW-15B, the basket bottom 152 is caused to close. If it is necessary to cause advance of the case discharge pusher 16, a switch SW-13 is momentarily closed to actuate the control relay CR-2 and cause advance of the case discharge pusher 16 as already described.

The machine illustrated in the drawings and described above is subject to structural modification without departing from the spirit and scope of the appended claims.

Having described our invention, what we claim as new and desire to secure by letters patent is:

1. A machine for placing flat articles in a case which comprises a basket having a floor which can be opened, means for forming a stack of the articles in the basket, vacuum cup means for engaging and holding a case below the basket with a top of the case open, means for impressing a vacuum on the vacuum cup means, a switch actuated by the vacuum when the case engages the vacuum cup means, means controlled by the switch for permitting completion of forming of the stack only when the vacuum cup means is engaged by the case, means for lowering the basket into close proximity to the case, and means for opening the basket floor to discharge the stack into the case.

2. A machine as in claim 1 which includes means for releasing the vacuum and for raising the basket when the basket floor has opened to release the basket from the case and means for advancing the case transversely to discharge the case.

3. A machine for placing flat articles in a case which comprises a basket having a floor which can be opened, means for forming a stack of the articles in the basket, means for holding a case below the basket with a top of the case open, means for lowering the basket into close proximity to the case, means for opening the basket floor to discharge the stack into the case, means for raising the basket when the basket floor has opened to release the basket from the case, a lift table adjacent the case holding means, means for advancing the case transversely onto the lift table, a discharge conveyor, means for raising the lift table to raise the case to the discharge conveyor, and means for advancing the case from the lift table onto the discharge conveyor.

4. A machine for placing flat articles in a case which comprises a basket having a floor which can be opened, means for forming a stack of the articles in the basket, means for holding a case below the basket with a top of the case open, means for lowering the basket into close proximity to the case, means for opening the basket floor to discharge the stack into the case, means for raising the basket when the basket floor has opened to release the basket from the case, a lift table adjacent the case holding means, means for advancing the case transversely onto the lift table, a discharge conveyor, means for raising the lift table to raise the case to the discharge conveyor, the lift table raising means tilting the lift table so that the case proceeds to the discharge conveyor under the influence of gravity.

5. A machine as in claim 4 which includes means for actuating the discharge conveyor which maintains the case stationary on the discharge conveyor at an inspection station for a sufficient time to permit inspection thereof and which then discharges the case.

* * * * *